US007283755B2

(12) United States Patent
Ishiguro et al.

(10) Patent No.: US 7,283,755 B2
(45) Date of Patent: Oct. 16, 2007

(54) REMAINING TONER DETECTION APPARATUS AND IMAGE FORMING APPARATUS PROVIDED WITH SAME

(75) Inventors: Yasuyuki Ishiguro, Osaka (JP); Akira Nakakuma, Nara (JP); Hideaki Kurimoto, Nara (JP); Kiyofumi Morimoto, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 233 days.

(21) Appl. No.: 10/995,162

(22) Filed: Nov. 24, 2004

(65) Prior Publication Data

US 2005/0117921 A1 Jun. 2, 2005

(30) Foreign Application Priority Data

Nov. 28, 2003 (JP) ..... 2003-399728

(51) Int. Cl.
*G03G 15/08* (2006.01)

(52) U.S. Cl. ..... 399/27

(58) Field of Classification Search ..... 399/27, 399/24

See application file for complete search history.

(56) References Cited

U.S. PATENT DOCUMENTS 5,649,264 A * 7/1997 Domon et al. ..... 399/27 X
5,655,175 A * 8/1997 Oshida ..... 399/27
6,173,130 B1 * 1/2001 Oguma ..... 399/27
6,337,956 B1 * 1/2002 Sato et al. ..... 399/27
6,405,006 B1 * 6/2002 Tabuchi ..... 399/162
2005/0105922 A1 * 5/2005 Kawai ..... 399/12

FOREIGN PATENT DOCUMENTS

JP 7-56431 A 3/1995

* cited by examiner

*Primary Examiner*—David M. Gray
*Assistant Examiner*—Erik J. Villaluna
(74) *Attorney, Agent, or Firm*—Birch, Stewart, Kolasch & Birch, LLP

(57) ABSTRACT

A pair of indentations is formed with a vertical spacing on a side wall of a toner cartridge, respective translucent windows are arranged on opposing upper and lower surfaces of the indentations protruding into the toner cartridge, and a light-emitting element and a light-receiving element of a remaining toner sensor are inserted to the indentations such that the light-emitting element and the light-receiving element of the remaining toner sensor face each other via the translucent windows of the indentations. When there is sufficient toner remaining in the toner cartridge, there is toner in the space between the transparent plates, and the space between a light-emitting diode and a phototransistor is blocked such that light is not incident on the phototransistor, whereas when there is little toner remaining in the toner cartridge, there is no toner in the space between the transparent plates, and the light is incident on the phototransistor via the space between the light-emitting diode and the photoresistor.

13 Claims, 15 Drawing Sheets

D

| | Duty ratio | Transistor 72a | Transistor 72b | Transistor 72c | Transistor 72d |
|---|---|---|---|---|---|
| Sensor of developing device 21a | 50% | ON | OFF | ON | ON |
| Sensor of developing device 21b | 60% | ON | OFF | OFF | ON |
| Sensor of developing device 21c | 40% | OFF | ON | ON | ON |
| Sensor of developing device 21d | 55% | OFF | OFF | ON | ON |

REMAINING TONER DETECTION APPARATUS AND IMAGE FORMING APPARATUS PROVIDED WITH SAME

CROSS REFERENCE TO RELATED APPLICATIONS

This application claims priority under 35 U.S.C. § 119(a) on patent application Ser. No. 2003-399728 filed in Japan on Nov. 28, 2003, the entire contents of which are hereby incorporated by reference.

BACKGROUND OF THE INVENTION

1. Field of the Invention

The present invention relates to a remaining toner detection apparatus that detects the amount of toner remaining in a toner cartridge of, for example, an electrographic or electrographic image forming apparatus and to an image forming apparatus provided with the same.

2. Description of the Related Art

Commonly known examples of electrographic or electrostatic image forming apparatuses include copying machines, printers, fax machines and the like. In such image forming apparatuses, an electrostatic latent image is formed on a photosensitive base and toner is supplied from a development apparatus to form a toner image on the photosensitive base, after which the electrostatic latent image is developed on the photosensitive base with toner. Thereafter, the toner image is transferred from the photosensitive base to a sheet of recording paper, and the toner image is fixed to the sheet of recording paper by applying heat and pressure to the sheet of recording paper.

Since toner is consumed in such image forming apparatuses, it is necessary to replenish toner. For example, a hopper is installed on the development apparatus and the toner cartridge is detachably fitted onto the hopper so that toner can be made to drop from the toner cartridge to the hopper, after which toner is supplied from the hopper to the development apparatus.

Furthermore, the amount of toner remaining in the toner cartridge is detected and indication is given when there is little remaining toner suggesting that the toner cartridge be replaced, thereby preventing in advance any break in the supply of toner.

A technique by which the remaining toner of a toner cartridge is detected using a remaining toner sensor that is constituted by a light-emitting element and a light-receiving element is disclosed in JP H07-56431A for example. More specifically, a vertical recess is provided near the bottom of the toner cartridge and two pairs of light-emitting elements and light-receiving elements are arranged in opposition to each other sandwiching the vertical recess. Toner is present in the vertical recess when there is sufficient toner, and therefore the light of each light-emitting element is blocked by the toner such that the light is not received by the light-receiving elements. Furthermore, when the amount of toner reduces and there is no toner in the vertical recess, the light-receiving elements receive the light from the light-emitting elements. Consequently, the output levels of the light-receiving elements are different when there is toner and when there is no toner, and it is possible to determine that there is no remaining toner based on the output levels of the light-receiving elements.

Furthermore, an elastic member is attached here to an agitator shaft that agitates the toner in the toner cartridge, and the elastic member is made to pass through the vertical recess by the rotation of the agitator shaft, so that the light irradiation surfaces of the light-emitting elements and the incident light surfaces of the light-receiving elements are cleaned by the elastic member.

However, with the apparatus disclosed in JP H07-56431A, even though the elastic member passes through the vertical recess to clean the light irradiation surfaces of the light-emitting elements and the incident light surfaces of the light-receiving elements, the light-emitting elements and the incident light surfaces of the light-receiving elements are always smeared since toner drops from above into the vertical recess immediately after this, and thus errors are made in determining the amount of remaining toner.

Furthermore, when there is little remaining toner, a repetitive action occurs by which toner is agitated and made to spatter up and then fall into the vertical recess, and therefore the toner level is not consistent and irregularity occurs in determining the amount of remaining toner.

The present invention has been devised in consideration of the conventional problems described above, and it is an object thereof to provide a remaining toner detection apparatus that can always accurately determine the amount of remaining toner and an image forming apparatus with the same.

SUMMARY OF THE INVENTION

In order to achieve the above-described object, in a remaining toner detection apparatus according to the present invention, a light-emitting element and a light-receiving element of a remaining toner sensor are detachably fitted to a toner cartridge, and that an amount of toner remaining in the toner cartridge is detected based on a light-receiving output of the light-receiving element when the light-emitting element emits light; wherein a pair of indentations is formed with a vertical spacing on a side wall of the toner cartridge, respective translucent windows are arranged on opposing upper and lower surfaces of the indentations protruding into the toner cartridge, and the light-emitting element and the light-receiving element of the remaining toner sensor are inserted to the indentations such that the light-emitting element and the light-receiving element of the remaining toner sensor face each other via the translucent windows of the indentations.

With the present invention, respective translucent windows are arranged on opposing upper and lower surfaces of the indentations protruding into the toner cartridge, and the light-emitting element and the light-receiving element of the remaining toner sensor are inserted to the indentations such that the light-emitting element and the light-receiving element of the remaining toner sensor face each other via the translucent windows of the indentations. In this way, a light path is formed in which light of the light-emitting element is incident on the light-receiving element through translucent windows of the indentations. When there is sufficient toner remaining in the toner cartridge, there is toner in the space between the translucent windows, and the light path is blocked such that light is not incident on the light-receiving element. Furthermore, when there is little toner remaining in the toner cartridge, there is no toner in the space between the translucent windows, and the light is incident on the light-receiving element via the light path. For this reason, the remaining toner in the toner cartridge can be determined based on the output level of light received at the light-receiving element.

Furthermore, since the indentations are arranged vertically, even when toner drops from above, the upper side indentation acts as a roof so that the toner is prevented from directly dropping on the space between the indentations, and it is difficult for the translucent windows of the indentations become smeared. In this way, it is possible to always accurately determine the remaining toner. Furthermore, since toner does not drop directly on the space between the indentations, the level of toner is kept stable in this space and it is possible to carry out very accurate determinations of the remaining toner.

Furthermore, in the present invention, it is also possible to provide a sweeping member that sweeps the translucent windows by intermittently passing between surfaces of the translucent windows.

In this case, it is possible to remove smearing from the translucent windows of the indentations and always accurately determine the remaining toner.

Furthermore, in the present invention, it is also possible that the sweeping member operates together with an agitation movement of an agitator member that agitates toner in the toner cartridge and intermittently passes between the surfaces of the translucent windows.

In this case, the sweeping member is made to operate together with the agitation movement of the agitator member, and therefore there is no need to arrange a separate mechanism to move the sweeping member.

Further still, in the present invention, it is possible that the sweeping member sweeps the surfaces of the translucent windows by passing in a substantially horizontal direction between the surfaces of the translucent windows.

In this case, since the sweeping member passes substantially horizontally between the translucent windows of the indentations and sweeps the translucent windows of the indentations, toner in the space between the indentations is kept uniform by the sweeping member, and smearing on the translucent windows of the indentations can be removed such that it is possible to carry out even more accurate determinations of the remaining toner.

Furthermore, in the present invention, it is possible that the sweeping member comprises a transparent material and a width of a support structure that supports the sweeping member is narrower than a width of a light path from the light-emitting element to the light-receiving element.

In this case, since the sweeping member is formed by a transparent material, and since the width of the support structure that supports the sweeping member is narrower than a width of a light path from the light-emitting element to the light-receiving element, the light path is not completely blocked by the sweeping member and the support structure, and it is possible to determine the remaining toner.

Moreover, in the present invention, the sweeping member may be a flexible film.

In this case, since the sweeping member is film with flexibility, when there is sufficient toner, the sweeping member is immersed, receives large resistance and bends in shape, and when there is little toner, the shape of the member recovers. Using this, when there is sufficient toner, the sweeping member is hindered from approaching the translucent windows of the indentations due to the shape change of the sweeping member, thus preventing the occurrence of abrasions to the surfaces of the translucent windows of the indentations due to sliding contact with the sweeping member. And when there is little toner, the sweeping member slides in contact with surfaces of the translucent windows of the indentations due to the recover of shape of the sweeping member, and the surfaces of the translucent windows of the indentations can be swept by the sliding contact with the sweeping member. Furthermore, if the sweeping member is a flexible film, even when the sweeping member slides in contact with the surfaces of the translucent windows of the indentations, these surfaces of the translucent windows are only lightly rubbed, and it is difficult to abrade the surfaces of the translucent windows. Furthermore, if the sweeping member is a flexible film, there is little friction between the sweeping member and the surfaces of the translucent windows of the indentations. For this reason, if the sweeping member is made to operate together with the agitation movement of the agitator member, it is possible to suppress increases to the load applied to the agitator member and there is no unevenness in the agitation movement of the agitator member.

Furthermore, in the present invention, it is possible that a depth of the toner cartridge is set shorter than a depth of a developing device in an image forming apparatus, and a height of the toner cartridge is set longer than the depth of the toner cartridge.

In this case, since the depth of the toner cartridge is set shorter than the depth of the developing device in an image forming apparatus, it is easy to make uniform the toner in the toner cartridge using agitation of the agitator member, and this reduces deviation in the toner, thus making it possible to carry out accurate determination of the remaining toner. Furthermore, since the height of the toner cartridge is set longer than the depth of the toner cartridge, the capacity of the toner cartridge can be maintained. It should be noted that, when comparing the depth of the toner cartridge and the depth of the developing device, it is preferable for the depth of the toner cartridge to be sufficiently shorter than the depth of the developing device.

Further still, in the present invention, it is possible that the toner cartridge is arranged in a vicinity of an openable-closeable front door in the image forming apparatus.

In this case, since the toner cartridge is arranged in a vicinity of an openable-closeable front door in the image forming apparatus, when such a short-depth toner cartridge is arranged in the vicinity of the front door in the image forming apparatus, it is extremely easy to perform toner cartridge replacements.

Furthermore, in the present invention, it is possible that the remaining toner sensor is arranged under a center of agitation of the agitator member that agitates toner in the toner cartridge, and it is possible that the remaining toner sensor is arranged directly under a center of agitation of the agitator member that agitates toner in the toner cartridge.

In this case, since the remaining toner sensor is arranged under or directly under the center of agitation of the agitator member, the toner in the toner cartridge is agitated by the agitator member such that the toner drops below or directly below the center of agitation. For this reason, reliable detection can be carried out by the remaining toner sensor even when there is very little remaining toner.

Furthermore, in the present invention, it is possible that a light-emitting element and a light-receiving element are fitted to a toner cartridge and the remaining toner in the toner cartridge is detected based on a light-receiving output of the light-receiving element when the light-emitting element emits light, wherein a flexible film is made to pass through a vicinity of a light-emitting face of the light-emitting element and a light-receiving face of the light-receiving element such that the light-emitting face and the light-receiving face are swept by the flexible film.

According to the present invention, regardless of the arrangement state of the light-emitting face of the light-emitting element and the light-receiving face of the light-receiving element, the flexible film is made to pass through the vicinity of the light-emitting face and the light-receiving face such that the light-emitting face and the light-receiving face are swept by the flexible film. The flexible film lightly rubs the light-emitting face and the light-receiving face and removes smearing from the light-emitting face and the light-receiving face without causing abrasion to the light-emitting face and the light-receiving face.

On the other hand, in another aspect of the present invention, an image forming apparatus is provided with an above-described remaining toner detection apparatus according to the present invention, wherein a plurality toner cartridges and a plurality of developing devices into which the toner cartridges are detachably fitted are arranged in tandem, and the toner cartridges are arranged in the vicinity of an openable-closeable front door.

In the present invention, since is it possible to bring the toner cartridges close to the front door, it is also possible to achieve miniaturization of an image forming apparatus. In particular, if a height h of the toner cartridge is set longer than a depth t of the toner cartridge and thus making the width of the toner cartridge even narrower, the toner cartridge can be miniaturized such that the image forming apparatus can also be further miniaturized.

DESCRIPTION OF THE INVENTION

Hereinafter, the present invention will be described by way of examples with reference to the accompanying drawings.

EXAMPLE 1

Figure 1:
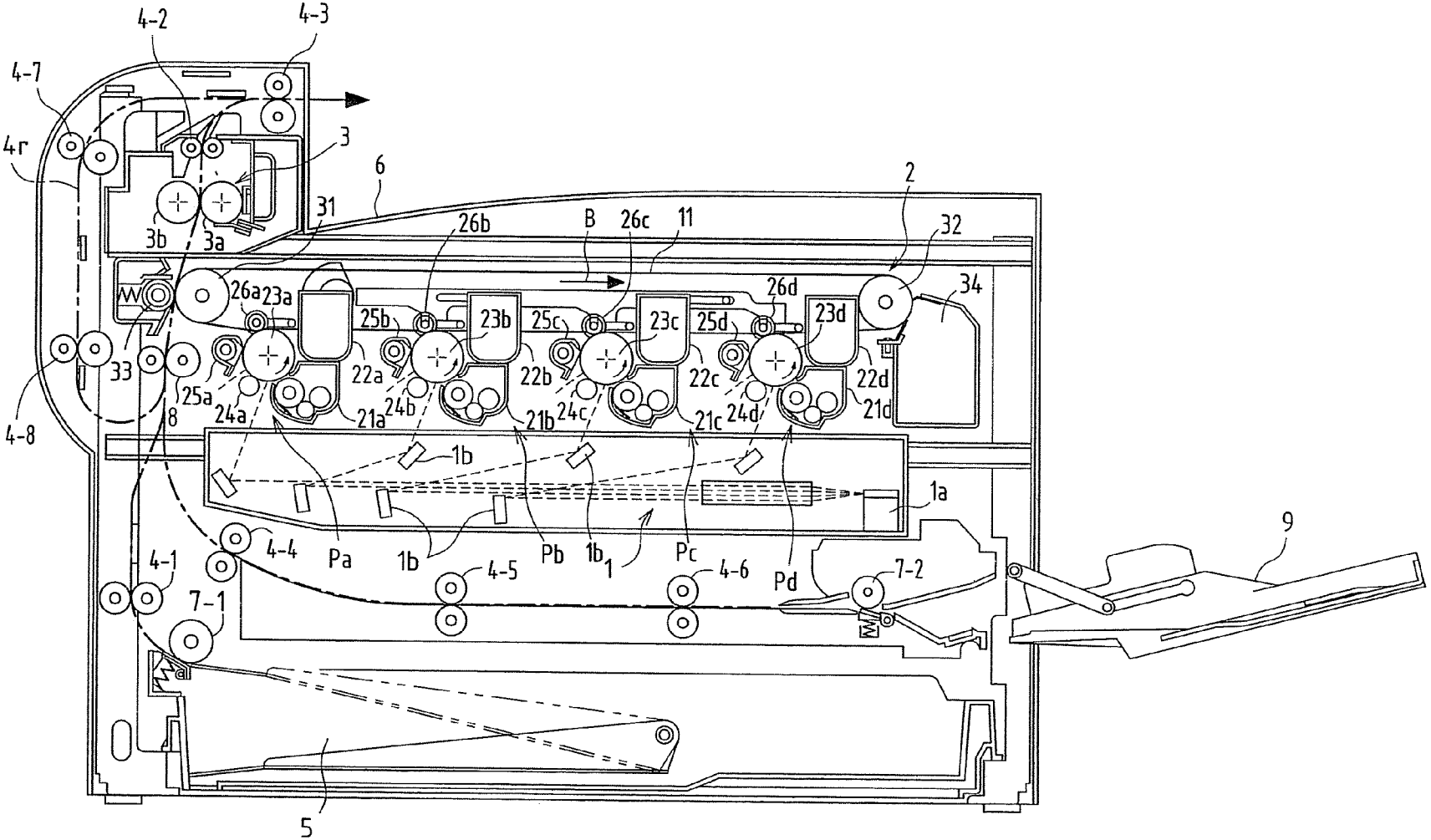
FIG. 1 is a lateral view showing an Example 1 of an image forming apparatus according to the present invention.

FIG. 1 is a lateral view showing an Example 1 of an image forming apparatus according to the present invention. The image forming apparatus of the present example is a color laser printer that records a color image on a sheet of recording paper and is provided with an exposure unit 1, image forming stations Pa, Pb, Pc, and Pd, an intermediate transfer belt unit 2, a fixing unit 3, a paper transport system 4, a paper supply tray 5, and a paper discharge tray 6.

With this image forming apparatus, sheets of recording paper are loaded and stored in the paper supply tray 5, then withdrawn from the paper supply tray 5 sheet by sheet by a pickup roller 7-1 and transported to a register roller 8 by a transport roller 4-1. Alternatively, a sheet of recording paper is loaded in a manual handling tray 9, then withdrawn by a pickup roller 7-2 and transported to the register roller 8 by transport rollers 4-4 to 4-6. The register roller 8 stops the sheet of recording paper, adjusts the leading edge of the sheet of recording paper, and transports the sheet of recording paper to a secondary transfer roller 13 with a timing in which the leading edge of the sheet of recording paper overlaps the leading edge of the toner image formed on an intermediate transfer belt 11 of the intermediate transfer belt unit 2.

The image forming stations Pa, Pb, Pc, and Pd respectively form toner images of black (K), cyan (C), magenta (M), and yellow (Y), and the toner image of each color is transferred to the intermediate transfer belt 11 of the intermediate transfer belt unit 2. The image forming stations Pa, Pb, Pc, and Pd are respectively provided with developing devices 21*a* to 21*d*, toner cartridges 22*a* to 22*d*, photosensitive drums 23*a* to 23*d*, charging devices 24*a* to 24*d*, and cleaner units 25*a* to 25*d*, for example.

The photosensitive drums 23*a* to 23*d* press on respective primary transfer rollers 26*a* to 26*d* via the intermediate transfer belt 11 and rotate with the intermediate transfer belt 11 at a peripheral velocity equivalent to the intermediate transfer belt 11, which rotationally moves in the direction of arrow B. Furthermore, the primary transfer rollers 26*a* to 26*d* also rotate following the intermediate transfer belt 11 at a peripheral velocity equivalent to the intermediate transfer belt 11, which rotationally moves in the direction of arrow B.

The charging devices 24*a* to 24*d* are roller-type or brush-type devices that contact the photosensitive drums 23*a* to 23*d*, or charger-type devices, and uniformly charge the surfaces of the photosensitive drums 23*a* to 23*d*.

The exposure unit 1 is provided with a laser light source 1*a* that irradiates laser light toward the respective photosensitive drums 23*a* to 23*d* and a plurality of mirrors 1*b* that guide the laser light onto the respective photosensitive drums 23*a* to 23*d*. The laser lights are irradiated onto the surfaces of the respective photosensitive drums 23*a* to 23*d* while being modulated in accordance with the image data, such that respective electrostatic latent images are formed on the surfaces of the respective photosensitive drums 23*a* to 23*d*.

It should be noted that a writing head in which light-emitting elements such as ELs and LEDs are arranged in an array may be used as the light-emitting element 1.

The toner cartridges 22*a* to 22*d* respectively hold black, yellow, magenta, and cyan toner. The developing devices 21*a* to 21*d* form toner images of these respective colors on the surfaces of the photosensitive drums 23*a* to 23*d* by causing toner of these respective colors supplied from the toner cartridges 22*a* to 22*d* to adhere to the electrostatic latent images on the photosensitive drums 23*a* to 23*d*. These toner images are transferred from the photosensitive drums 23*a* to 23*d* to the intermediate transfer belt 11 and overlaid.

The intermediate transfer belt unit 2 is provided with the intermediate transfer belt 11, primary transfer rollers 26*a* to 26*d*, a drive support roller 31, a slave support roller 32, and a secondary transfer roller 33. The intermediate transfer belt 11 is rotatably supported by being wound around the drive support roller 31 and the slave support roller 32, and the primary transfer rollers 26*a* to 26*d* and the secondary transfer roller 33 are pressed against the intermediate transfer belt 11.

The intermediate transfer belt 11 is made of a synthetic resin film of a thickness in the range of 100 μm to 150 μm for example. The secondary transfer roller 33 is supported so as to be movable laterally, and when it is moved rightward it sandwiches the intermediate transfer belt 11 with the drive support roller 31 and forms a nip area. The drive support roller 31 fulfills a role of being a backup roller of the secondary transfer roller 33 and causes the respective nip areas between the primary transfer rollers 26*a* to 26*d* and the photosensitive drums 23*a* to 23*d* to rotationally drive downstream so that the intermediate transfer belt 11 is pulled and made to rotationally move in a direction of arrow B. In this way, the nip areas are maintained stably.

It should be noted that it is preferable that one of the primary transfer rollers 26*a* to 26*d* and the photosensitive drums 23*a* to 23*d* is made of a hard material and the other is made of a flexible material in order to more stably form the respective nip areas between the primary transfer rollers 26*a* to 26*d* and the photosensitive drums 23*a* to 23*d*.

Each of the primary transfer rollers 26*a* to 26*d* is made of, for example, a metal shaft of a diameter in the range of 8 mm to 10 mm, the circumference of which is covered by a conductive elastic material (such as EPDM and urethane foam). With the intermediate transfer belt 11 sandwiched in the nip areas between the primary transfer rollers 26*a* to 26*d* and the photosensitive drums 23*a* to 23*d*, a bias voltage having a polarity that is opposite to the charged polarity of the toner is applied to the primary transfer rollers 26*a* to 26*d* such that the respective electrical fields act on the toner on the surfaces of the photosensitive drums 23*a* to 23*d* through the intermediate transfer belt 11, and the toner on the surfaces of the photosensitive drums 23*a* to 23*d* is attracted and transferred to the intermediate transfer belt 11. In this way the toner images of the colors are transferred to the intermediate transfer belt 11 and overlaid.

It should be noted that brushes or the like may be used instead of rollers as the primary transfer rollers 26*a* to 26*d*.

The cleaning unit 34 includes, for example, a cleaning blade that slides in contact with the surface of the intermediate transfer belt 11, and removes toner remaining on the surface of the intermediate transfer belt 11 to prevent such defects as fogging of the next image to be printed.

In this way, the toner image of each color transferred and overlaid onto the intermediate transfer belt 11 is transported to the nip area between the drive support roller 31 and the secondary transfer roller 33 in accordance with the rotational movement of the intermediate transfer belt 11. Then, the leading edge of the sheet of recording paper transported by the register roller 8 is overlaid with the leading edge of the toner image of the colors on the intermediate transfer belt 11, and the toner image of the colors and the sheet of recording paper are overlaid so that the toner image of the colors is transferred to the sheet of recording paper.

After this, the sheet of recording paper is transported to the fixing unit 3 and is here sandwiched between a pressure roller 3*a* and a heat roller 3*b*. In this way, the toner of the colors on the sheet of recording paper is thermally melted and mixed so that the toner image of the colors is made to adhere to the sheet of recording paper as a color image.

The sheet of recording paper is transported to the paper discharge tray 6 by the paper transport system 4 and discharged here facedown.

It should be noted that it is also possible to use only the image forming station Pa to form a monochrome image and transfer the monochrome image to the intermediate transfer belt 11 of the intermediate transfer belt unit 2. As with the color image, the monochrome image is transferred from the intermediate transfer belt 11 to the sheet of recording paper and made to adhere to the sheet of recording paper.

Furthermore, when carrying out printing not only on the front surface of the sheet of recording paper but on both surfaces, after the image on the front surface of the sheet of recording paper is fixed by the fixing unit 3 and while the transport roller 4-3 of the paper transport system 4 is transporting the sheet of recording paper, the transport roller 4-3 can be made to stop and then rotate in reverse. The front and back of the sheet of recording paper are inverted via an inversion route 4*r* of the paper transport system 4, and once the front and back of the sheet of recording paper are inverted, the sheet of recording paper is guided to the register roller 8 and an image is recorded and fixed on the back side of the sheet of recording paper in the same way as the front side of the sheet of recording paper, after which the sheet of recording paper is discharged to the paper discharge tray 6.

Figure 2:
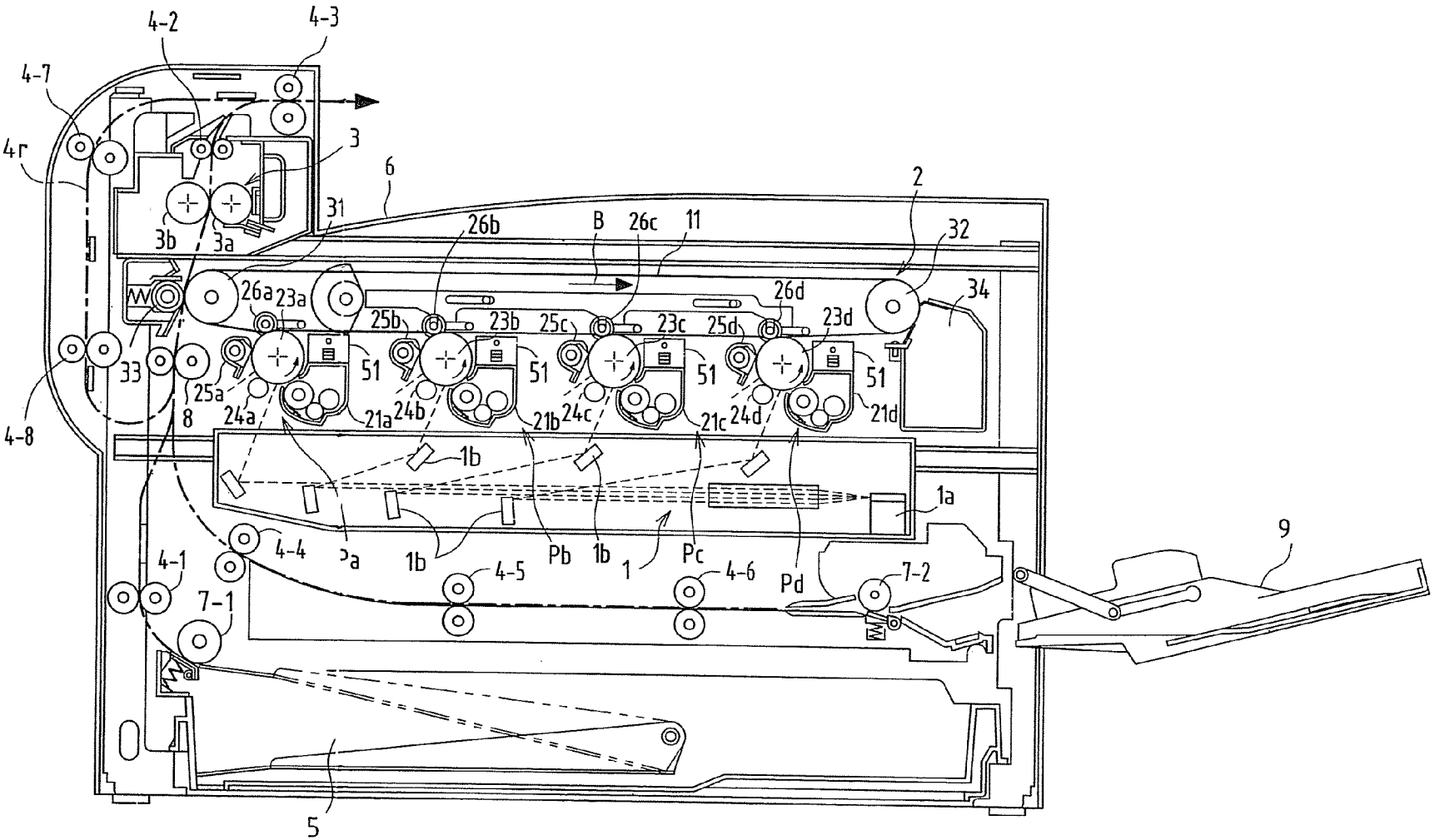
FIG. 2 is a lateral view of the toner cartridges of the image forming apparatus shown in FIG. 1 in a removed state.

Also note that, with the image forming apparatus of the present example, each of the toner cartridges 22*a* to 22*d* can be detached from the developing devices 21*a* to 21*d* as shown in FIG. 2 such that the toner of the colors can be replenished by replacing each of the toner cartridges 22*a* to 22*d* with new ones.

Figure 3:
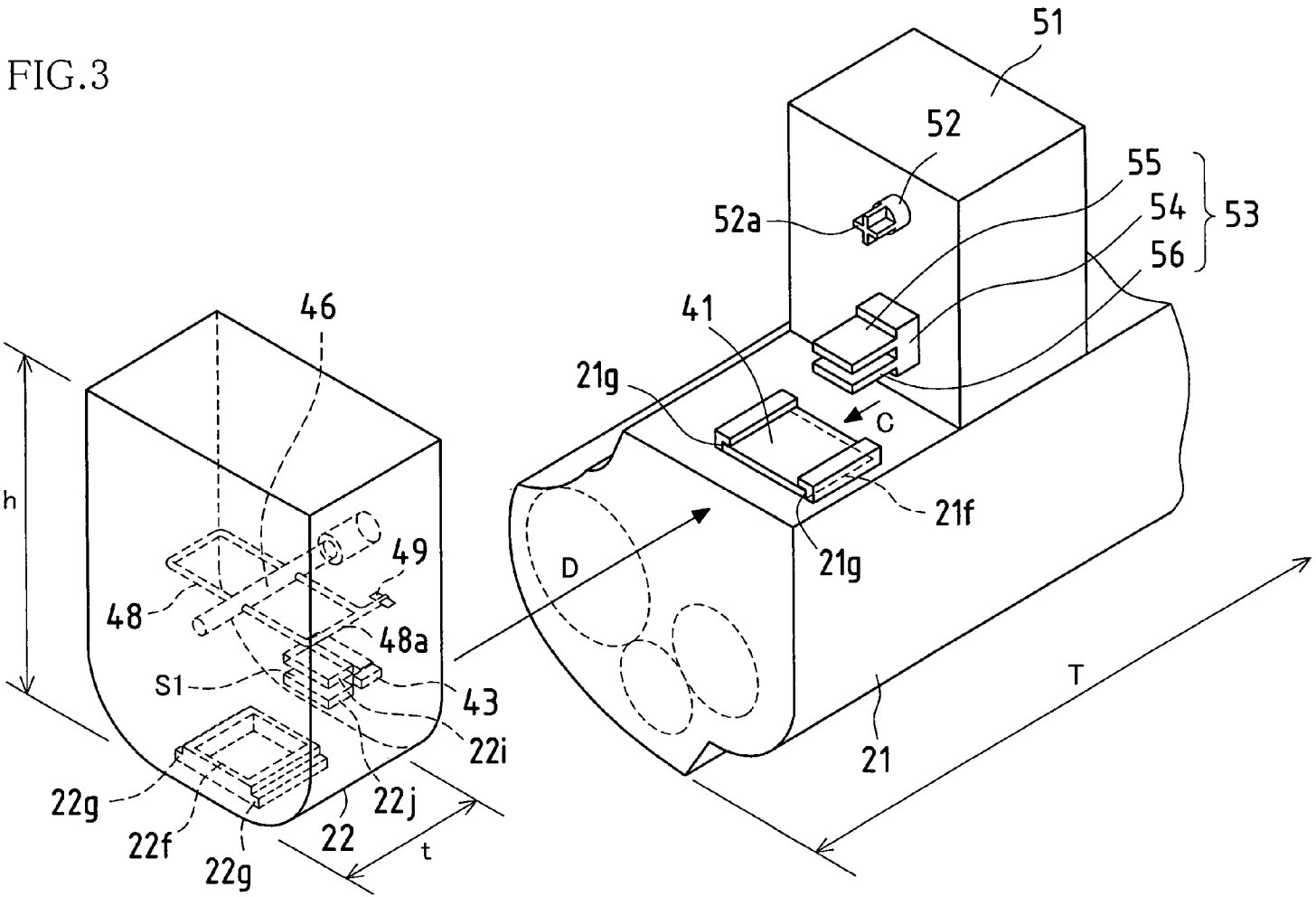
FIG. 3 is a perspective view showing the state prior to when a toner cartridge is fitted into a developing device as viewed from the front.
Figure 4:
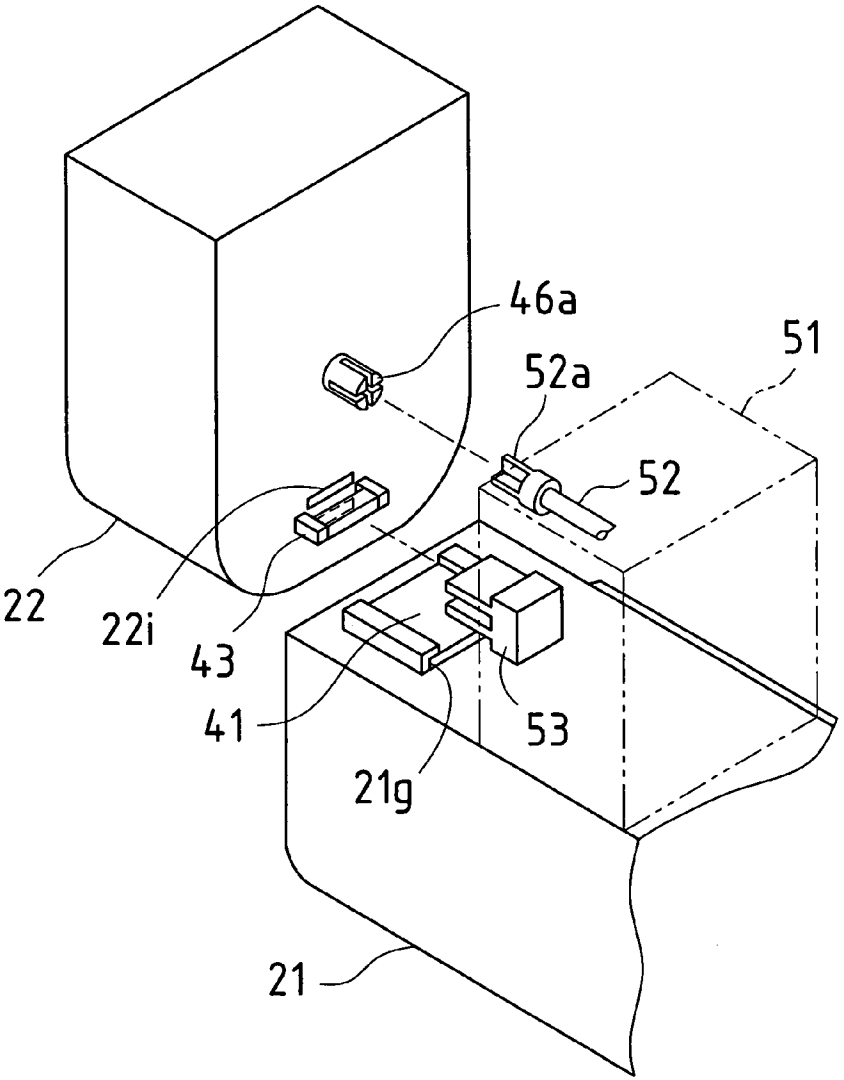
FIG. 4 is a perspective view showing the toner cartridge and the developing device prior to fitting as viewed from the rear.
Figure 5:
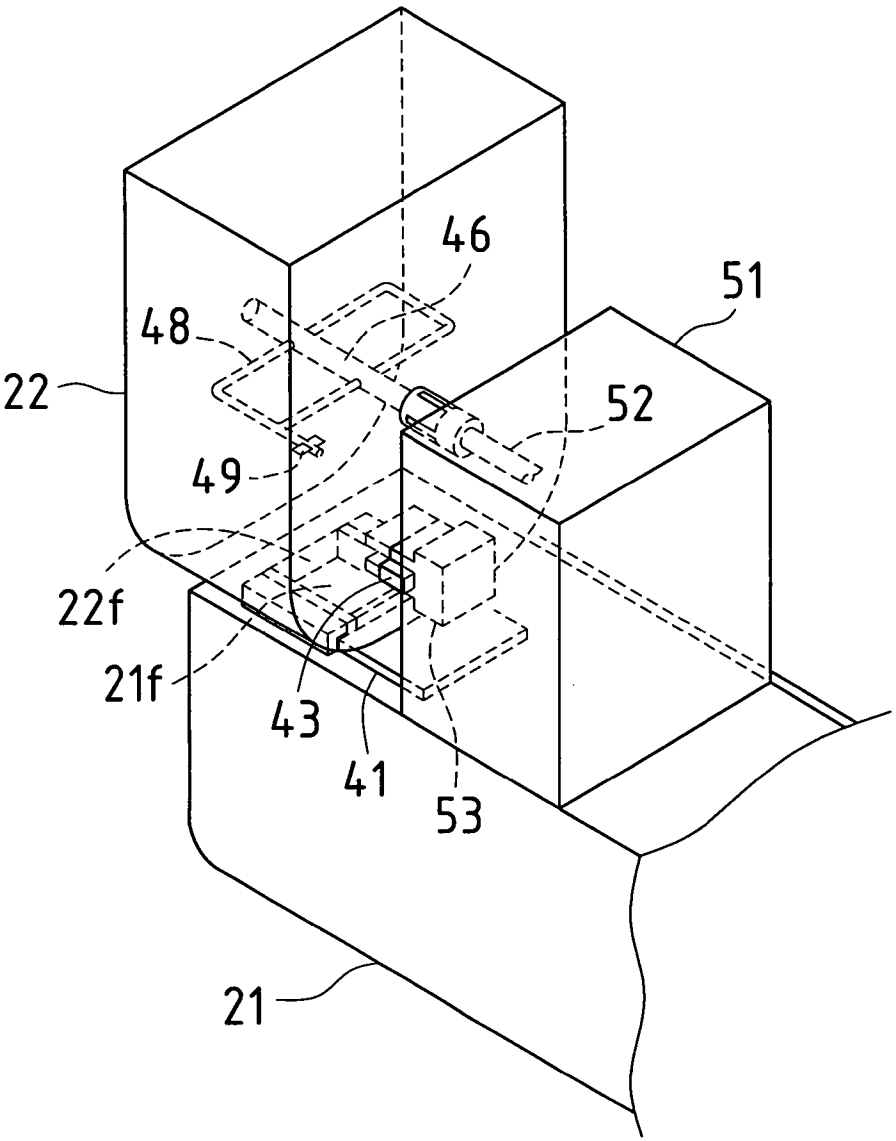
FIG. 5 is a perspective view showing the toner cartridge and the developing device after fitting as viewed from the rear.
Figure 6:
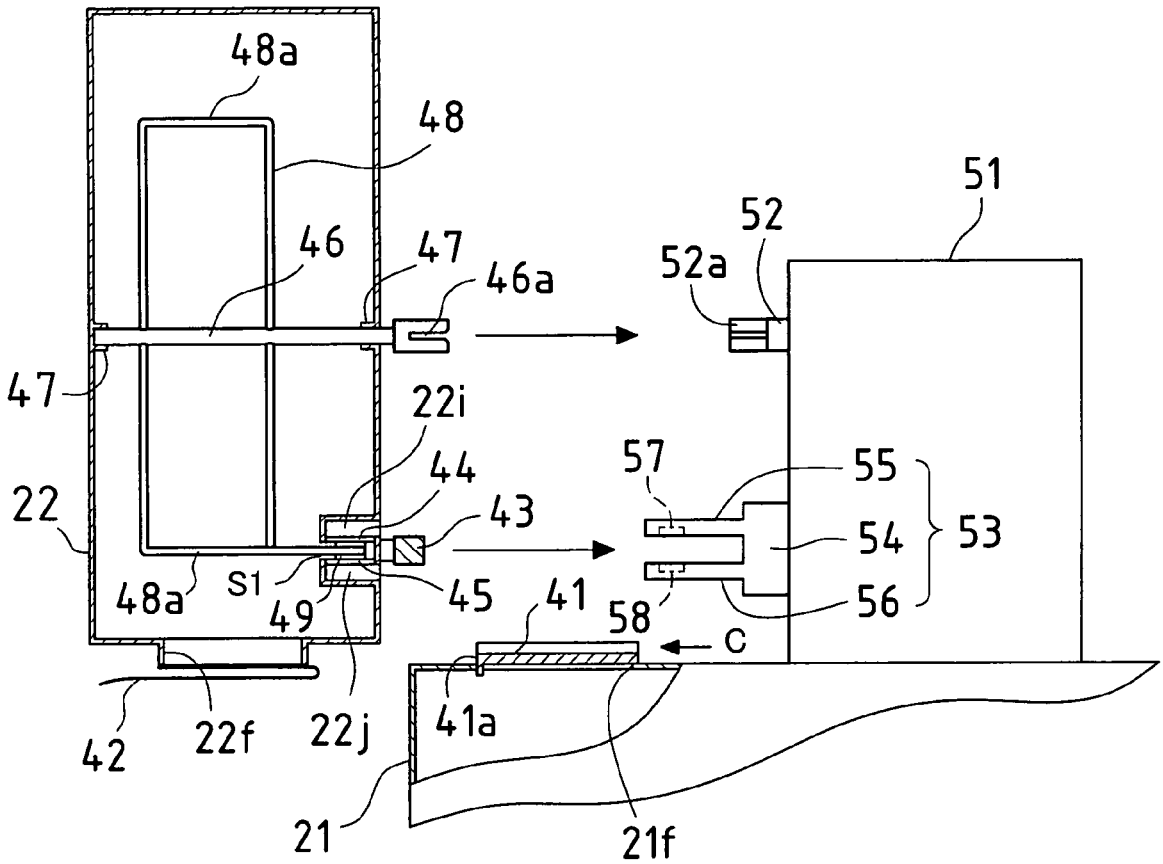
FIG. 6 is a longitudinal sectional view showing the toner cartridge and the developing device prior to fitting as viewed from the side.
Figure 7:
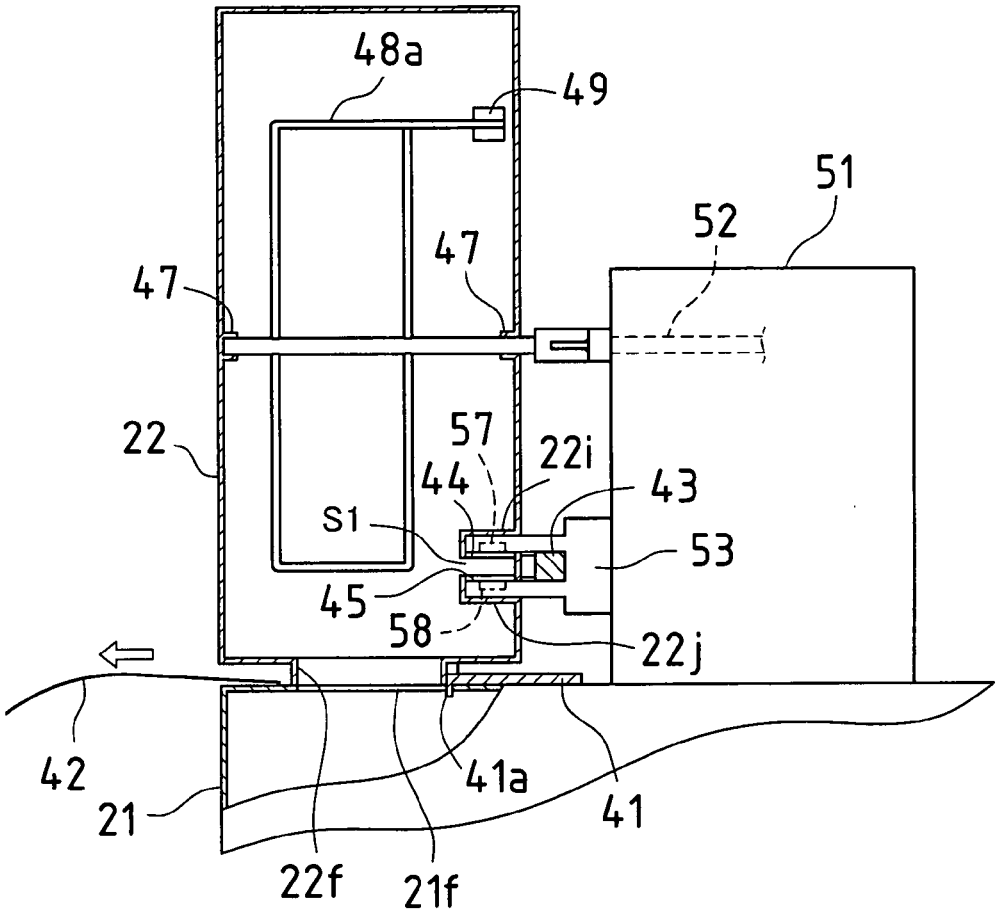
FIG. 7 is a longitudinal sectional view showing the toner cartridge and the developing device after fitting as viewed from the side.
Figure 8:
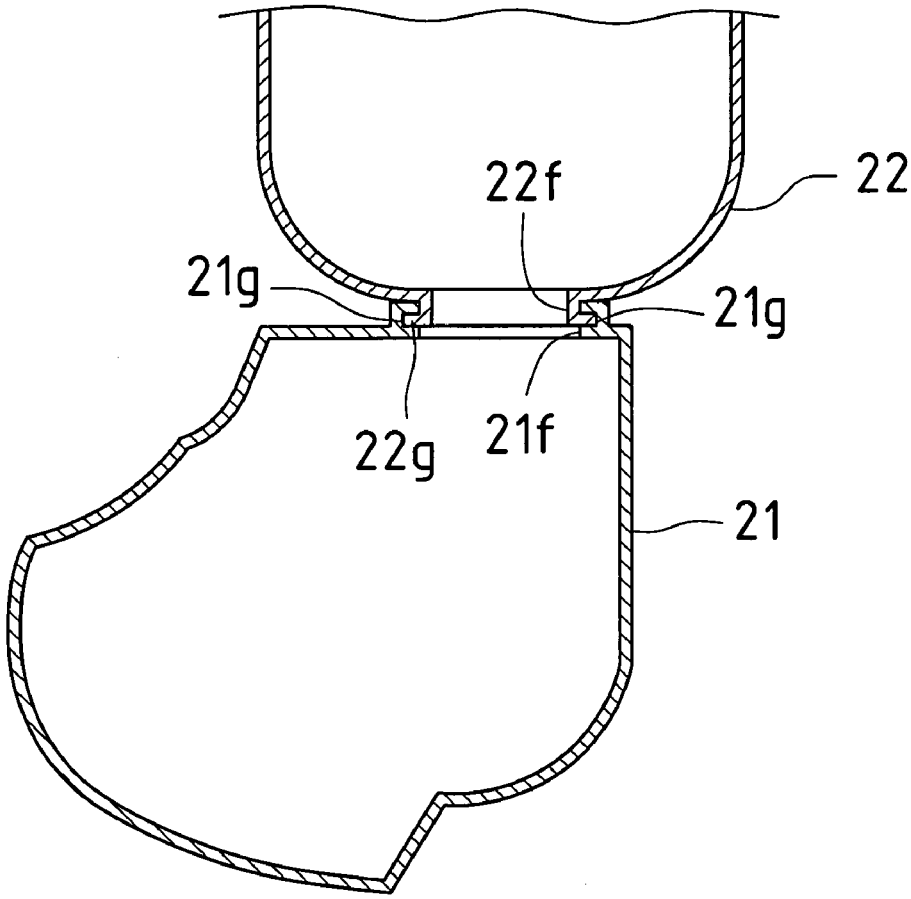
FIG. 8 is an enlarged cross-sectional view showing the toner cartridge and the developing device after fitting as viewed from the front.
Figure 9:
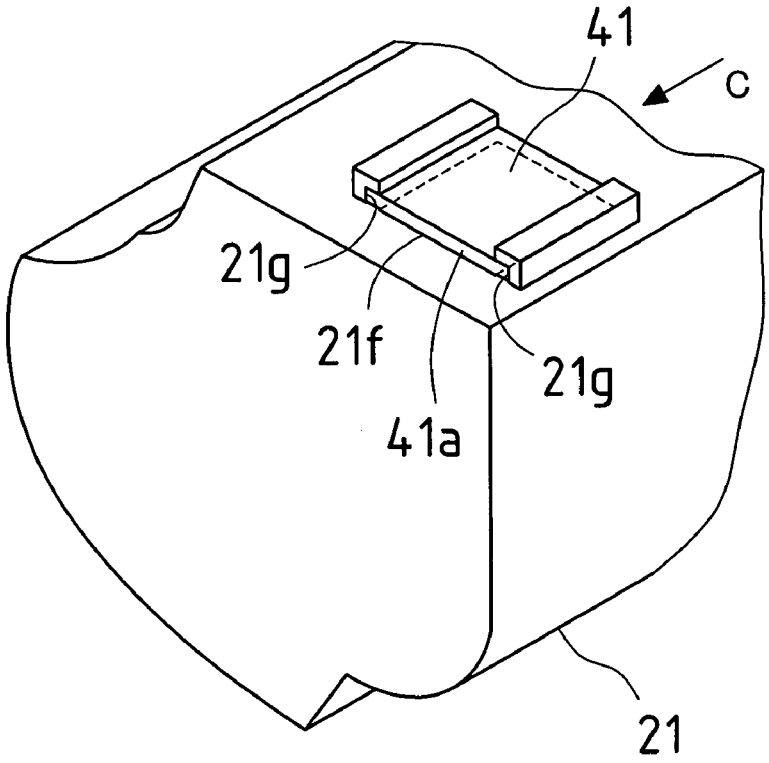
FIG. 9 is an enlarged perspective view of the developing device as viewed from the front.

The following is a description of the toner cartridges 22*a* to 22*d*. FIG. 3 is a perspective view showing the state prior to when the toner cartridge 22 (using 22 as a common reference numeral for the toner cartridges 22*a* to 22*d*) is fitted to the developing device 21 (using 21 as a common reference numeral for the developing devices 21*a* to 21*d*) as viewed from the front. Furthermore, FIG. 4 is a perspective view showing the toner cartridge 22 and the developing device 21 prior to fitting as viewed from the rear. Moreover, FIG. 5 is a perspective view showing the toner cartridge 22 and the developing device 21 after fitting as viewed from the rear. FIG. 6 is a longitudinal sectional view showing the toner cartridge 22 and the developing device 21 prior to fitting as viewed from the side, and FIG. 7 is a longitudinal sectional view showing the toner cartridge 22 and the developing device 21 after fitting as viewed from the side. FIG. 8 is an enlarged cross-sectional view showing the toner cartridge 22 and the developing device 21 after fitting as viewed from the front, and FIG. 9 is an enlarged perspective view of the developing device 21 as viewed from the front.

Although the depth t of the toner cartridge 22 is made sufficiently shorter than the depth T of the developing device 1, its height h is made sufficiently longer than its depth t to ensure the capacity therein. By shortening the depth t of the toner cartridge 22, the toner cartridge 22 does not interfere with interior components of the image forming apparatus when the toner cartridge 22 is fitted from the front side of the image forming apparatus. Furthermore, since the toner cartridge 22 is at the most near side when opening the front door of the image forming apparatus, it is easy to replace the toner cartridge 22.

As shown in FIG. 8, the toner cartridge 22 is provided with a toner supply port 22*f* at the bottom and flanges 22*g* at the periphery of the toner supply port 22*f*. Furthermore, the developing device 21 is provided with a toner receiving inlet 21*f* at its top and guiding grooves 21*g* on both sides of the toner receiving inlet 21*f* As shown in FIG. 9, a guide plate 41 inserts to the guiding grooves 21*g* and a force is applied by springs (not shown in drawings) to the guide plate 41 toward the near side of the image forming apparatus (arrow direction C) so that an edge 41*a* of the guide plate 41 is brought into contact with the edge of the toner receiving inlet 21*f* and the guide plate 41 closes the developing device 21.

In fitting the toner cartridge 22, the toner cartridge 22 is placed on the top of the developing device 21, and the flanges 22*g* of the toner cartridge 22 insert to the guiding grooves 21*g* of the developing device 21 by sliding the toner cartridge 22 toward the interior (the direction of arrow D in FIG. 3) of the toner cartridge such that the guide plate 41 is opened by being pushed by the flanges 22*g* of the toner cartridge 22, and the toner supply port 22*f* of the toner cartridge 22 and the toner receiving inlet 21*f* of the developing device 21 overlap. Then, as shown in FIG. 7, by pulling and removing a double-folded seal 42 that seals the toner supply port 22*f* of the toner cartridge 22, it becomes possible to supply toner from the toner cartridge 22 to the developing device 22 passing between the toner supply port 22*f* of the toner cartridge 22 and the toner receiving inlet 21*f* of the developing device 21.

When there is no longer any toner in the toner cartridge 22, the toner cartridge 22 can be caused to slide toward the front of the image forming apparatus and removed.

In this way, the toner cartridge 22 can be fitted and removed, and replacements can be performed.

Furthermore, an upper indentation 22*i* and a lower indentation 22*j* are formed on the inner wall of the toner cartridge 22, with a cleaning member 43 provided extending between the upper indentation 22*i* and the lower indentation 22*j*. Inside the toner cartridge 22, the upper indentation 22*i* and the lower indentation 22*j* protrude inwardly. A transparent plate 44 (referred to as a light casting window in the present invention) is attached to the lower surface of the upper indentation 22*i* and a transparent plate 45 (referred to as a light casting window in the present invention) is attached to the upper surface of the upper indentation 22*j* such that the transparent plates 44 and 45 are arranged in opposition to each other and a space S1 is provided between the transparent plates 44 and 45.

Figure 10:
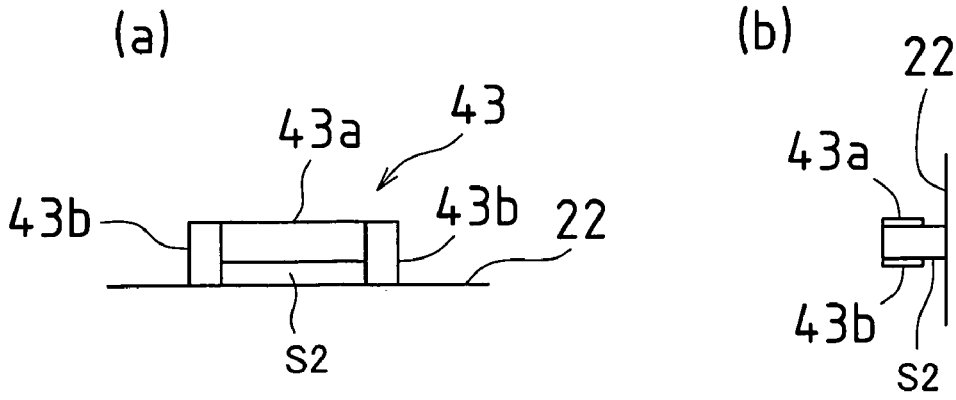
FIGS. 10(*a*) and 10(*b*) are a top view and a lateral view of a cleaning member of the toner cartridge.

FIGS. 10(*a*) and 10(*b*) are a top view and a lateral view of a cleaning member 43. As clearly shown in FIGS. 10(*a*) and 10(*b*), the cleaning member 43 is such that a pair of support pieces 43*b* protrude on the inner wall of the toner cartridge 22 and an elastic piece 43*a* is supported by the support pieces 43*b*, thereby providing a space S2 between the elastic piece 43*a* and the inner wall of the toner cartridge 22.

Figure 11:
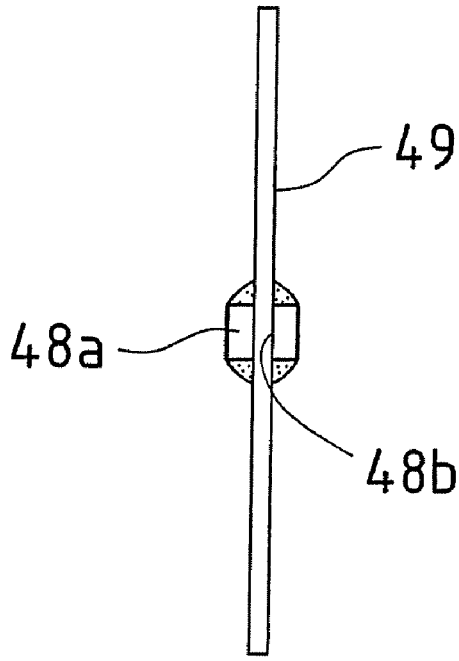
FIG. 11 is an enlarged front view of a flexible film attached to an agitator portion of the toner cartridge.

Moreover, in the toner cartridge 22, a driven shaft 46 is rotatably supported by a pair of shaft bearings 47, and an agitator member 48 is fixedly supported at the driven shaft 46. One end of the driven shaft 46 protrudes from the side wall of the toner cartridge 22, forming a cross-shaped groove 46*a* at that end face. The agitator member 48 includes rods 48*a*, which are fixed in combination in a substantially rectangular form. One of the rods 48*a* parallel to the driven shaft 46 protrudes to the vicinity of an inner wall of the toner cartridge 22 and a flexible film piece 49 (referred to as a sweeping member in the present invention) is attached to this one end of the rod 48*a*. As shown enlarged in FIG. 11, a slit 48*b* is formed at one end of the rod 48*a* and the flexible film piece 49 inserts into the slit 48*b* and is fixed with an adhesive material, with the flexible film piece 49 perpendicularly crossing the columnar surface defined by the rotational trajectory of the rods 48*a*.

Figure 12:
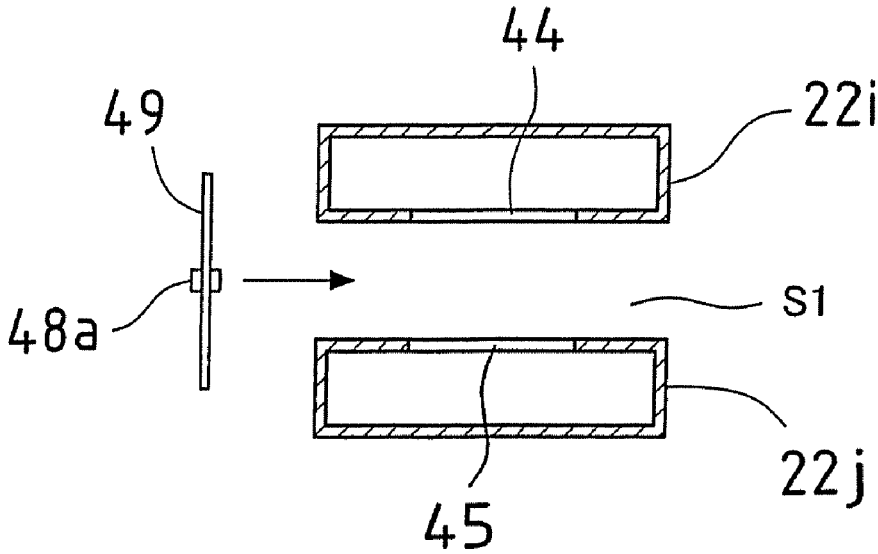
FIG. 12 is a front view showing the flexible film piece passing through a space between the transparent plates along with the agitation of the agitator member of the toner cartridge.

When the driven shaft 46 rotates, the agitator member 48 is caused to rotate, thus agitating the toner in the toner cartridge 22. Furthermore, the flexible film piece 49 also rotates along with the rotation of the agitator member 48. When this happens, the rod 48*a* that protrudes to the vicinity of the inner wall of the toner cartridge 22 passes through the space S1 between the transparent plates 44 and 45 while rotating as shown in FIG. 12, and the flexible film piece 49 also passes through the space S1.

On the other hand, a cartridge drive portion 51 is arranged on the main side of the image forming apparatus above the developing device 21. A drive shaft 52 is pivoted in the cartridge drive portion 51 and a cross-shaped end 52*a* of the drive shaft 52 protrudes to the near side of the image forming apparatus. The drive shaft 52 is rotationally driven by a motor and a gear unit (not shown in drawings). Furthermore, a remaining toner sensor 53 is attached to the inner wall of the cartridge drive portion 51.

The remaining toner sensor 53 is provided with a base portion 54 fixed to the side wall of the cartridge drive portion 51, a light-emitting portion 55, and a light-receiving portion 56, with the light-emitting portion 55 and the light-receiving portion 56 arranged in opposition to each other protruding from the base portion 54. The light-emitting portion 55 accommodates a light-emitting diode 57 and the light of the light-emitting diode 57 is irradiated toward the light-receiving portion 56. The light-receiving portion 56 accommodates a phototransistor 58 and the light from the light-emitting diode 57 is received by the phototransistor 58.

When the toner cartridge 22 is placed on the top of the developing device 21, then slid toward the interior of the image forming apparatus and fitted such that the toner supply port 22*f* of the toner cartridge 22 and the toner receiving inlet 21*f* of the developing device 21 overlap as described above, the cross-shaped end 52*a* of the drive shaft 52 of the cartridge drive portion 51 couples with the cross-shaped groove 46*a* of the driven shaft 46 of the toner cartridge 22 such that the drive shaft 52 and the driven shaft 46 are linked and the light-emitting portion 55 and the light-receiving portion 56 of the remaining toner sensor 53 are coupled at the upper indentation 22*i* and the lower indentation 22*j* of the toner cartridge 22.

Then, when the cross-shaped end 52*a* of the drive shaft 52 and the cross-shaped groove 46*a* of the driven shaft 46 are coupled, the drive shaft 52 and the driven shaft 46 are linked, with the rotation of the drive shaft 52 being transmitted to the driven shaft 46. Accordingly, when the drive shaft 52 of the cartridge drive portion 51 is rotationally driven, the driven shaft 46 of the toner cartridge 22 rotates such that the agitator member 48 also rotates. The toner inside the toner cartridge 22 is agitated by the rotation of the agitator member 48 and the flexible film piece 49 also rotates, periodically passing through the space S1 between the transparent plates 44 and 45.

Furthermore, when the light-emitting portion 55 and the light-receiving portion 56 of the remaining toner sensor 53 are coupled at the upper indentation 22*i* and the lower indentation 22*j* of the toner cartridge 22, the light-emitting diode 57 of the light-emitting portion 55 and the phototransistor 58 of the light-receiving portion 56 face each other through the transparent plate 44 of the upper indentation 22*i* and the transparent plate 45 of the lower indentation 22*j* and the space S1.

Figure 13:
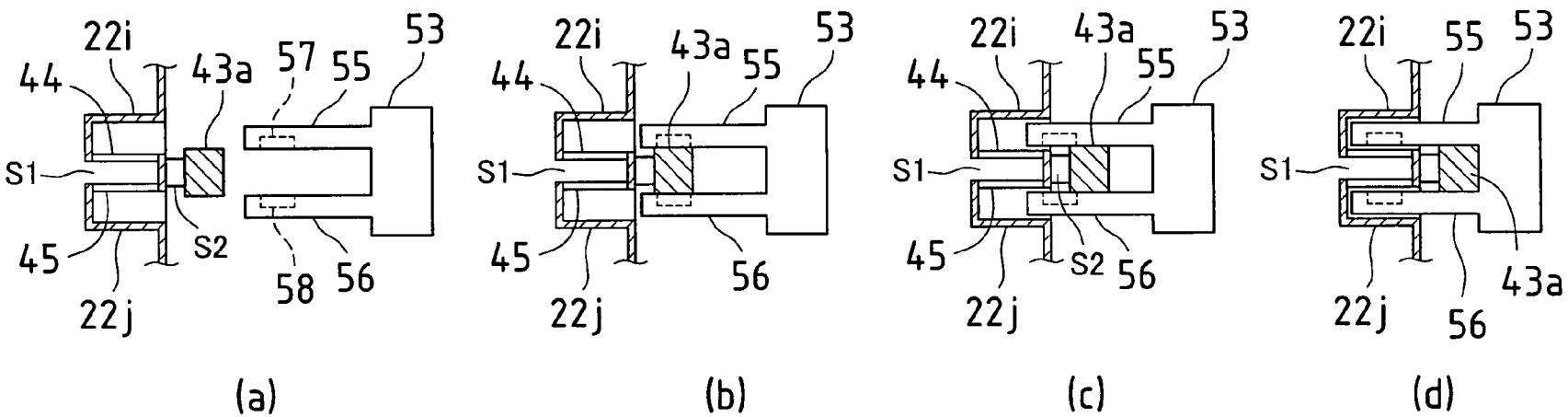
FIGS. 13(*a*) to 13(*d*) are front views showing the light-emitting face of the light-emitting portion and the light-receiving face of the light-receiving portion of the remaining toner sensor being cleaned by the cleaning member of the toner cartridge when attaching/removing the toner cartridge.

When the toner cartridge 22 is placed on the top of the developing device 21, then slid toward the interior of the image forming apparatus and fitted as described above, the light-emitting face of the light-emitting portion 55 and the light-receiving face of the light-receiving portion 56 of the remaining toner sensor 53 slide in contact with the elastic piece 43*a* of the cleaning member 43 as shown in FIGS. 13(*a*) to 13(*d*), and the toner smearing on the light-emitting face and the light-receiving face is scraped away by the elastic piece 43*a*. For this reason, toner detections carried out by the light-emitting portion 55 and the light-receiving portion 56, which are described below, are not hindered by the smearing on the light-emitting face of the light-emitting portion 55 and the light-receiving face of the light-receiving portion 56.

Since the light-emitting face of the light-emitting portion 55 and the light-receiving face of the light-receiving portion 56 of the remaining toner sensor 53 slide in contact with the elastic piece 43*a* of the cleaning member 43, the light-emitting face of the light-emitting portion 55, the light-receiving face of the light-receiving portion 56, and the elastic piece 43*a* are subjected to frictional electrification. When the light-emitting face of the light-emitting portion 55 and the light-receiving face of the light-receiving portion 56 are charged with a polarity opposite to that of the toner, toner tends to adhere to the light-emitting face and the light-receiving face. Conversely, when the light-emitting face of the light-emitting portion 55 and the light-receiving face of the light-receiving portion 56 are charged with a same polarity as the toner, toner is hindered from adhering to the light-emitting face and the light-receiving face. Furthermore, when the elastic piece 43*a* of the cleaning member 43 is charged with a same polarity as the toner, toner tends to adhere to the elastic piece 43*a*, such that toner on the light-emitting face and the light-receiving face is removed excellently. Conversely, when the elastic piece 43*a* of the cleaning member 43 is charged with a polarity opposite to that of the toner, toner is hindered from adhering to the elastic piece 43*a*. For this reason, materials for the light-emitting face of the light-emitting portion 55, the light-receiving face of the light-receiving portion 56, and the elastic piece 43*a* are selected so that the light-emitting face and the light-receiving face are subjected to frictional electrification to the same polarity as the toner, and the elastic piece 43*a* is subjected to frictional electrification to the polarity opposite to that of the toner.

Figure 14:
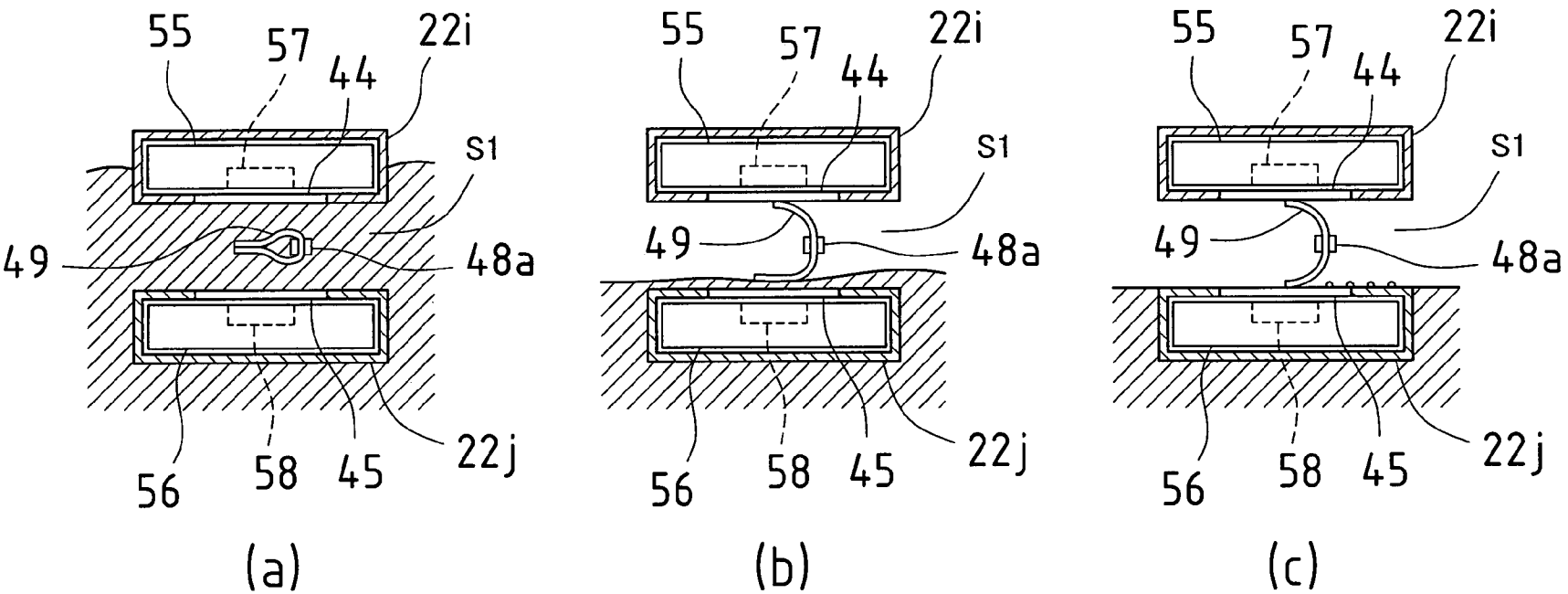
FIGS. 14(*a*) to 14(*c*) are front views used for describing the detection of remaining toner in the toner cartridge by the remaining toner sensor.

When there is sufficient toner in the toner cartridge 22 as shown here in FIG. 14(*a*) and the space S1 between the transparent plates 44 and 45 is filled with toner, light from the light-emitting diode 57 of the light-emitting portion 55 is blocked by the toner in the space S1, and the light is not received by the phototransistor 58 of the light-receiving portion 56. Furthermore, the flexible film piece 49 rotates along with the agitator member 48 and is bent on both sides of the rod 48*a* as it receives the resistance of the toner when immersed in the toner, substantially forming a double-folded condition. For this reason, when passing through the space S1 between the transparent plates 44 and 45, the flexible film piece 49 does not contact the transparent plates 44 and 45, and there is no rubbing of toner against the surfaces of the transparent plates 44 and 45 from sliding contact with the flexible film piece 49, which allows the surfaces of the transparent plates 44 and 45 to not be subject to abrasion.

When the amount of toner in the toner cartridge 22 is diminishing as shown in FIG. 14(*b*) and the toner level is between the transparent plates 44 and 45, since the lower side transparent plate 44 is covered by toner, light from the light-emitting diode 57 of the light-emitting portion 55 is absorbed to some degree by the toner in the space S1, and a weak light is received by the phototransistor 58 of the light-receiving portion 56. Furthermore, when the flexible film piece 49 passes through the space S1 between the transparent plates 44 and 45, both sides of the rods 48*a* are bent, with the lower side edge making the toner uniform, and the upper side edge sliding in contact with the surface of the transparent plate 44, thereby scraping away the toner smearing on this surface.

Moreover, when the amount of toner in the toner cartridge 22 is further diminished as shown in FIG. 14(*c*) and the toner level is at or below the lower side transparent plate 45, there is no longer any toner in the space S1 and light from the light-emitting diode 57 of the light-emitting portion 55 is passes through the transparent plates 44 and 45, and this light is received by the phototransistor 58 of the light-receiving portion 56. Accordingly, almost all of the light from the light-emitting diode 57 is received by the phototransistor 58 without being weakened. Furthermore, when the flexible film piece 49 passes through the space S1 between the transparent plates 44 and 45, both sides of the rods 48*a* are bent, and both side edges slide in contact with the surfaces of the transparent plates 44 and 45 such that toner smearing on these surfaces is scraped away. For this reason, light from the light-emitting diode 57 of the light-emitting portion 55 is not weakened by smearing on the surfaces of the transparent plates 44 and 45, and light from the light-emitting diode 57 is reliably received by the phototransistor 58. Furthermore, the little remaining toner is agitated by the rotation of the agitator member 48 and although the toner is spattered up and then drops down, toner that falls in the vicinity of the transparent plates 44 and 45 is obstructed by the upper indentation 22*i* that protrudes inwardly to the toner cartridge 22, and therefore the surfaces of the transparent plates 44 and 45 are not smeared by this falling toner. In other words, the upper indentation 22*i* fulfills a role of a roof that prevents toner from dropping onto the transparent plates 44 and 45.

Since the flexible film piece 49 slides in contact with the surfaces of the transparent plates 44 and 45, the flexible film piece 49 and the transparent plates 44 and 45 are subject to frictional electrification. When the transparent plates 44 and 45 are charged with a polarity opposite to that of the toner, toner tends to adhere to the transparent plates 44 and 45. Conversely, when the transparent plates 44 and 45 are charged with a same polarity as the toner, toner is hindered from adhering to the transparent plates 44 and 45. For this reason, materials for the flexible film piece 49 and transparent plates 44 and 45 are selected so that the transparent plates 44 and 45 are subjected to frictional electrification to the same polarity as the toner. Examples of materials for the flexible film piece 49 include flexible materials such as polyethylene terephthalate, polyimide, and polyamide. Accordingly, it is necessary to establish materials for the transparent plates 44 and 45 in accordance with the material of the flexible film piece 49. Alternatively, conversely to this, it is also possible to establish materials for the flexible film piece 49 in accordance with the materials of the transparent plates 44 and 45 after determining the materials for the transparent plates 44 and 45.

In this way, when the level of toner in the toner cartridge 22 exceeds the lower side transparent plate 45, light is not received by the phototransistor 58, and when the level of toner is between the transparent plates 44 and 45, a weak light is received by the phototransistor 58, and when the level of toner is at or below the lower side transparent plate 45, almost all of the light from the light-emitting diode 57 is received by the phototransistor 58 without being weakened. For this reason, the level of remaining toner in the toner cartridge 22 can be determined based on the output level of light received at the phototransistor 58.

Furthermore, when the level of toner in the toner cartridge 22 is at or below the lower side transparent plate 45, smearing on the surfaces of the transparent plates 44 and 45 is scraped away by the flexible film piece 49, and the upper indentation 22*i* acts as a roof for the transparent plates 44 and 45, thereby preventing toner from dropping of toner onto the transparent plates 44 and 45, and therefore light from the light-emitting diode 57 of the light-emitting portion 55 is not weakened by smearing on the surfaces of the transparent plates 44 and 45 so that detection of the remaining level of toner can be reliably carried out by the remaining toner sensor 53.

Moreover, since toner does not drop in the space S1 between the transparent plates 44 and 45, the level of toner in the space S1 is kept stable. Additionally, the flexible film piece 49 passes through the space S1 in a substantially horizontal direction, and therefore the toner in the space S1 is kept uniform. And since the depth t of the toner cartridge 22 is set sufficiently shorter than the depth T of the developing device 21, it is easy to keep the toner in the toner cartridge 22 uniform with the agitation from the agitator member 48 such that there is little deviation in the overall toner of the toner cartridge 22. For this reason, detection of the remaining level of toner can be reliably carried out by the remaining toner sensor 53.

Furthermore, the remaining toner sensor 53 is arranged directly under the center of agitation of the agitator member 48, and therefore the toner in the toner cartridge 22 is agitated by the agitator member 48 such that it drops directly below the center of agitation, thereby making the toner level stable in the vicinity of the remaining toner sensor 53. For this reason, reliable detection can be carried out by the remaining toner sensor 53 even when there is very little remaining toner. It should be noted that substantially the same effect can be obtained even when the remaining toner sensor 53 is arranged below the center of agitation but not directly below the center of agitation of the agitator member 48.

Further still, even though the flexible film piece 49 slides in contact with the surfaces of the transparent plates 44 and 45, these surfaces are only lightly brushed and it is difficult to abrade these surfaces. Also, it is possible to reduce the friction between the flexible film piece 49 and these surfaces and suppress increases to the load applied to the agitator member 48, thereby eliminating the occurrence of rotational unevenness of the agitator member 48.

Figure 15:
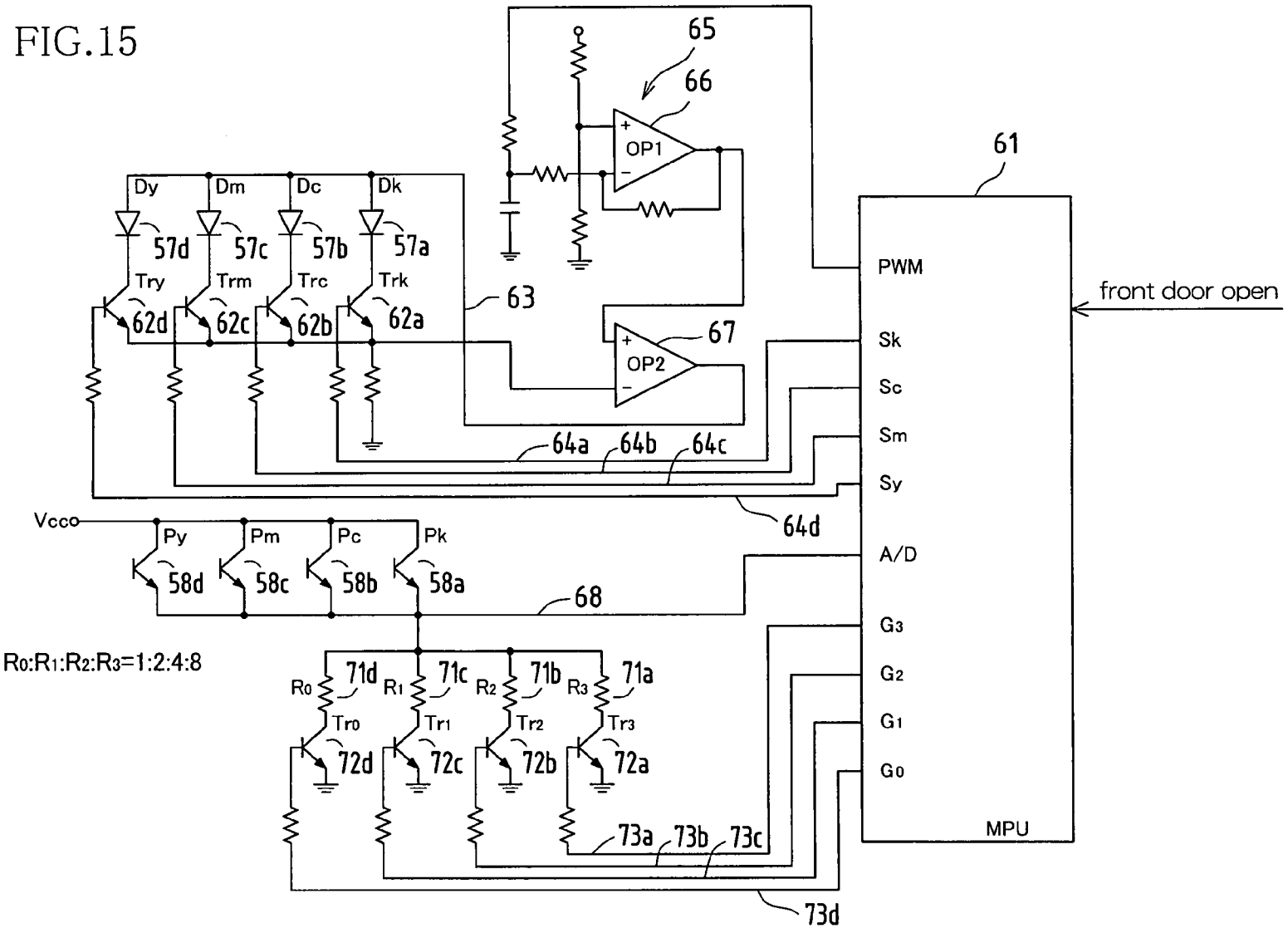
FIG. 15 is a block diagram showing the remaining toner detection apparatus in the image forming apparatus of the present example.

FIG. 15 is a block diagram showing a remaining toner detection apparatus in an image forming apparatus according to the present example. In this remaining toner detection apparatus, the light-emitting diode 57*a* and the phototransistor 58*a*, the light-emitting diode 57*b* and the phototransistor 58*b*, the light-emitting diode 57*c* and the phototransistor 58*c*, and the light-emitting diode 57*d* and the phototransistor 58*d* are respectively the remaining toner sensor 53 for detecting the remaining toner in the toner cartridges 22*a*, 22*b*, 22*c*, and 22*d*.

A control portion 61 provides individual drive control for the light-emitting diodes 57*a* to 57*d*, receives the light-receiving output of the phototransistors 58*a* to 58*d* via a wired OR, and detects the level of remaining toner in the toner cartridges 22*a* to 22*d* based on the light-receiving output level of the phototransistors 58*a* to 58*d*. Also, in addition to regulating the drive currents of the light-emitting diodes 57*a* to 57*d*, the control portion 61 regulates the load resistance of the phototransistors 58*a* to 58*d*, and thus corrects and keeps consistent the toner detection sensitivity of each remaining toner sensor 53. These corrections are carried out to prevent reductions in detection accuracy of the level of remaining toner by compensating for unevenness in the characteristics of the light-emitting diodes 57*a* to 57*d* and the phototransistors 58*a* to 58*d*, and compensating for reductions in light transmission efficiency between the light-emitting diodes and the transistors caused by abrasions to the light-emitting face of the light-emitting diodes and the light-receiving face of the transistors.

Here, each of the light-emitting diodes 57*a* to 57*d* is associated and serially connected with respective transistors 62*a* to 62*d*. The anodes of the light-emitting diodes 57*a* to 57*d* are commonly connected by a line 63, the emitters of the transistors 62*a* to 62*d* are also commonly connected, and the bases of the transistors 62*a* to 62*d* are connected to terminals Sy, Sm, Sc, and Sk of the control portion 61 via respective lines 64*a* to 64*d*. The control portion 61 selects and turns ON any one of the transistors 62*a* to 62*d* via the lines 64*a* to 64*d*. When any one of the transistors 62*a* to 62*d* is selected and turned ON, the serial circuit between the selected transistor and the light-emitting diode of that transistor becomes conductive.

The control portion 61 generates rectangular wave output of the duty ratio corresponding to the rated drive current and outputs the rectangular wave voltage from a terminal PWM to a smoothing circuit 65. The smoothing circuit 65 is constituted by various resistors, capacitors, and a first operational amplifier 66. The smoothing circuit 65 smoothes the rectangular wave output and outputs a mean voltage of the rectangular wave output to a second operational amplifier 67. In addition to receiving the voltage from the smoothing circuit 65 at a non-inverting input terminal, the second operational amplifier 67 receives the voltage from the serial circuit of the selected transistor and light-emitting diode, which are in a conductive state, at an inverting input terminal and outputs the difference between the voltage of the non-inverting input terminal and the inverting input terminal. This makes a rated drive current, which corresponds to the duty ratio of the rectangular wave output from the terminal PWM of the control portion 61, flow along the serial circuit of the selected, conductive-state transistor and light-emitting diode such that the light-emitting diode emits light with a light intensity corresponding to the rated drive current. That is to say, when the rectangular wave output is output from the terminal PWM of the control portion 61, a mean voltage of the rectangular wave output is generated by the smoothing circuit 65, then this voltage undergoes voltage-current conversion at the second operational amplifier 67 and a rated drive current is generated corresponding to the duty ratio of the rectangular wave output, then the rated drive current flows in the serial circuit of the selected, conductive transistor and light-emitting diode such that the light-emitting diode emits light with a light intensity corresponding to the rated drive current. Accordingly, it is possible to control the light intensity of the light-emitting diode by regulating the duty ratio of the rectangular wave output from the terminal PWM.

Furthermore, the emitters of the phototransistors 58*a* to 58*d* are connected to a wired OR by a line 68, the resistors 71*a* to 71*d* and transistors 72*a* to 72*d* are respectively associated and serially connected, the resistors 71*a* to 71*d* are connected to the line 68, the emitters of the transistors 72*a* to 72*d* are connected, and the bases of the transistors 72*a* to 72*d* are respectively connected to terminals G0, G1, G2, and G3 of the control portion 61 via respective lines 73*a* to 73*d*.

The control portion 61 selectively turns ON 0 to 4 of the transistors 72*a* to 72*d* via the lines 73*a* to 73*d*. In this way, 0 to 4 of the resistors 71*a* to 71*d* are selectively inserted between the line 68 and the ground to regulate the resistance value between the line 68 and the ground, and set the resistance load of the phototransistors 58*a* to 58*d*. For example, the resistance value between the line 68 and the ground is regulated by setting the ratio of resistance values R3, R2, R1, and R0 of the resistors 71*a* to 71*d* at 8:4:2:1 and selectively inserting 0 to 4 of the resistors 71*a* to 71*d*.

With such a circuit configuration, as described above, the control portion 61 outputs the rated drive current via the smoothing circuit 65 and the second operational amplifier 67 while selectively turning ON any of the transistors 62*a* to 62*d* such that a drive current flows through the serial circuit of the selected transistor and light-emitting diode and causing this light-emitting diode of one of the remaining toner sensors 53 to emit light. When this happens, the level of light received by the phototransistor of the remaining toner sensor 55 is determined in accordance with the level of remaining toner in the toner cartridge in which the remaining toner sensor 55 is set. The control portion 61 receives light-receiving output of the phototransistor of the remaining toner sensor 53 at a terminal A/D via the wired OR of the line 68 and monitors this light-receiving output, thereby determining the level of remaining toner in the toner cartridge based on the light-receiving output.

Figures 16, 17:
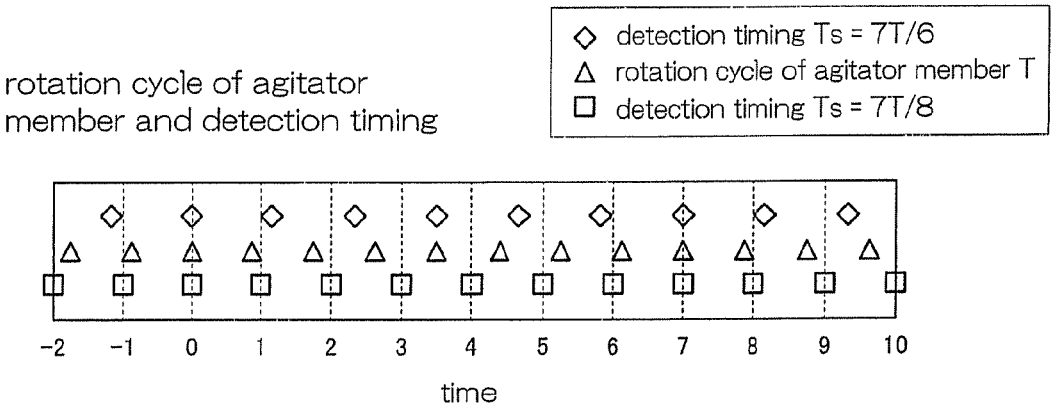
FIG. 16 is a conceptual diagram showing a correction data table D used in correcting the remaining toner sensor.
FIG. 17 is a graph showing a rotation cycle T of the flexible film that rotates along with the agitator member of the toner cartridge and a detection cycle Ts of the remaining toner sensor.

Then, based on a correction data table D such as the one shown in FIG. 16, the control portion 61 corrects the toner detection sensitivity for each separate remaining toner sensor 53, then determines the level of remaining toner based on the detection output of the remaining toner sensor 53. As described above, these corrections involve regulating the drive currents of the light-emitting diodes 57*a* to 57*d*, regulating the load resistance of the phototransistors 58*a* to 58*d*, and thus correcting and keeping consistent the toner detection sensitivity of each remaining toner sensor 53. More specifically, based on the correction data table D, the control portion 61 obtains the duty ratio corresponding to the drive current of the light-emitting diode of the remaining toner sensor 53, then generates and outputs a rectangular waveform output of the duty ratio such that the drive current is made to flow to the light-emitting diode through the smoothing circuit 65 and the second operational amplifier 67. At the same time, based on the correction data table D, the control portion 61 selects 0 to 4 of the transistors 72*a* to 72*d*, then turns ON those of the transistors 72*a* to 72*d* that have been selected and sets the resistance value of the remaining toner sensor 53. As a result, it is possible to accurately determine the level of remaining toner in each of the toner cartridges 22*a* to 22*d* without unevenness using the remaining toner sensors 53.

Furthermore, the control portion 61 repeats detections with the same remaining toner sensor 53 for a prescribed number of times in a fixed cycle and, after obtaining the respective detection results, extracts a plurality of detection results that are the same and removes detection results that are different, then determines the level of remaining toner in the toner cartridge based on the plurality of detection results that are the same. For example, as shown in the graph of FIG. 17, the rotation cycle of the flexible film 49, which rotates along with the agitator member 48, is given as T, the detection cycle of the remaining toner sensor 53 is given as Ts, with Ts=7T/6 in which detections by the remaining toner sensor 53 are set to repeat 6 times with a fixed cycle 7T, then a one-time detection result that is different is removed to extract 5 times of detection results, which should be the same, and the level of toner remaining in the toner cartridge is determined based on the detection results of the five times. Alternatively, with Ts=7T/8, in which detections by the remaining toner sensor 53 are set to repeat 8 times with a fixed cycle 7T, a one-time detection result that is different is removed to extract 7 times of detection results, which should be the same, and the level of toner remaining in the toner cartridge is determined based on the detection results of the seven times.

This is because, since detections of remaining toner with the remaining toner sensor 53 are difficult when the flexible film 49 passes through the space S1 between the transparent plates 44 and 45 and the light path between the light-emitting diode and the phototransistor of the remaining toner sensor 53 is blocked by the flexible film 49, by slightly displacing the rotation cycle T of the flexible film 49 and the detection cycle Ts of the remaining toner sensor 53 and increasing the number of times of detection of the remaining toner sensor 55 carried out when the flexible film 49 is not passing through the space S1 as well as decreasing the number of times of detection of the remaining toner sensor 53 carried out when the flexible film 49 is passing through the space S1, and additionally, by extracting a plurality of detection results that are the same and removing a detection result of one time that is different, only the detection results of when the flexible film 49 is not passing through the space S1 are obtained. In this way, it is possible to accurately determine the level of remaining toner.

Such a determination is repeated each time the remaining toner sensor 55 of each of the developing devices 21*a* to 21*d* is successively selected. Then, when the control portion 61 determines that the level of remaining toner is low in one of the toner cartridges 22*a* to 22*d*, a counting is started of the number of printed dots (corresponding to the consumed amount of that color toner) with respect to the toner image of the color of the toner cartridge in which the level of remaining toner has become low, and when the number of printed dots reaches a predefined value, it is presumed that there is no longer any toner in that toner cartridge, and a toner cartridge replacement is urged by indicating on an indicator unit (not shown in drawings) of the toner cartridge that no longer has toner, or by emitting a sound message from a speaker (not shown in drawings), thus preventing in advance disruptions to the supply of toner.

The following is a description of the correction data table D in FIG. 16. Firstly, the correction data table D is set to initial settings at the time the image forming apparatus is shipped from the factory. This is in order to compensate for unevenness in the characteristics of the light-emitting diodes and the phototransistors of the remaining toner sensors 53.

For example, while the toner cartridges 22*a* to 22*d* are disconnected, the control portion 61 successively selects the remaining toner sensor 53 of each of the developing devices 21*a* to 21*d*. Each time a remaining toner sensor 53 is selected, a drive current is sent to the light-emitting diode of the selected toner cartridge 53, and while the control portion receives the light-receiving output of the phototransistor of the remaining toner sensor 53, the drive current is varied by varying the duty ratio of the rectangular wave output and the resistance load of the phototransistor of the remaining toner sensor 53 is varied by turning ON and OFF the transistors 72*a* to 72*d* so that the light-receiving output level of the phototransistor can be adjusted to a rated value. Then, the duty ratio and the ON/OFF state of the transistors 72*a* to 72*d* are obtained when the light-receiving output level becomes the rated value, and these duty ratios and ON/OFF states of the transistors 72*a* to 72*d* are recorded in the correction data table D. In this way, the duty ratios of the rectangular wave output and ON/OFF states of the transistors 72*a* to 72*d* for correcting and keeping uniform the toner detection sensitivity of each remaining toner sensor 53 of the developing devices 21*a* to 21*d* are recorded in the correction data table D.

Furthermore, the correction data table D can be updated during toner cartridge replacements even after purchase by the user. These corrections are carried out to prevent reductions in detection accuracy of the level of remaining toner by compensating for reductions in light transmission efficiency between the light-emitting diodes and the transistors caused by abrasions to the light-emitting face of the light-emitting diodes and the light-receiving face of the phototransistors of the remaining toner sensor 53.

For example, when the control portion 61 determines that there is no remaining toner in the toner cartridge 22*a*, replacement of the toner cartridge is urged in such ways as displaying an indication on an indicator unit (not shown in drawings) of the toner cartridge 22*a*, which has no remaining toner, or by emitting a sound message from a speaker (not shown in drawings). When this happens, in order to replace the toner cartridge 22*a*, it is necessary that the user follows a procedure in which the user opens the front door of the image forming apparatus, removes the toner cartridge 22*a*, and mounts a new toner cartridge 22*a* on the developing device 21*a*. Then, when the control portion 61 uses a limit switch (not shown in drawings) and detects that the front door of the image forming apparatus has been opened, the toner cartridge 22*a* that was determined to have no remaining toner is presumed to have been replaced, and the light-emitting diode of the remaining toner sensor 53 of the developing device 21*a* is caused to emit light continuously while the light-receiving output of the phototransistor of this remaining toner sensor 53 continues to be monitored.

Figure 18:
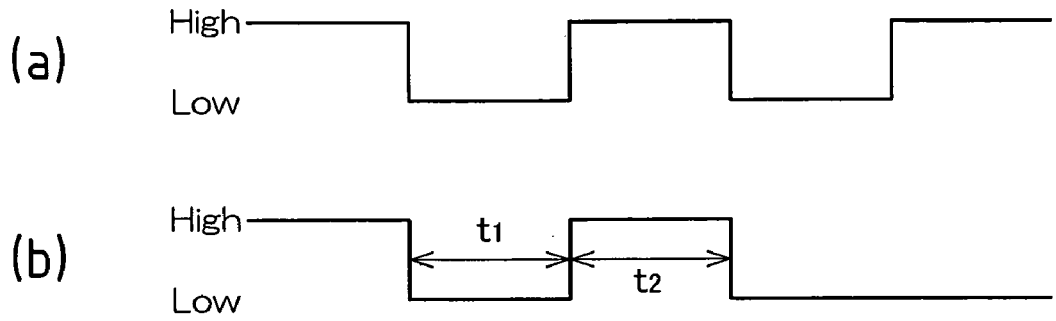
FIGS. 18(*a*) and 18(*b*) are graphs showing variation in the detection output of the remaining toner sensor when attaching/removing the toner cartridge.

By removing the toner cartridge 22*a*, the remaining toner sensor 53 also becomes removed from the toner cartridge 22*a*. During this removal, as shown in FIGS. 13(*d*), (*c*), (b), and (a), the light path between the light-emitting diode and the phototransistor of the remaining toner sensor 53 runs through the space S1 between transparent plates 44 and 45, is temporarily blocked by an inner wall 22*e* of the toner cartridge 22*a*, then again passes the space S2 of the cleaning member 43, is again blocked by the elastic piece 43*a* of the cleaning member 43, after which it continues to pass through to outside the image forming apparatus. In accordance with this, the light-receiving output of the phototransistor of the remaining toner sensor 53 changes from high level, to low level, to high level, to low level, and to high level as shown in FIG. 18(*a*). Then, when the control portion 61 detects the changed pattern of FIG. 18(*a*) in regard to the light-receiving output of the phototransistor of the remaining toner sensor 53 being monitored, it is presumed that the toner cartridge 22*a* has been removed.

After this, a new toner cartridge 22*a* is mounted such that the remaining toner sensor 53 is placed in the toner cartridge 22*a*. When this happens, as shown in FIGS. 13(*a*), (*b*), (c), and (d), the light path between the light-emitting diode and the phototransistor of the remaining toner sensor 53 runs through to outside the image forming apparatus, is blocked by the elastic piece 43*a* of the cleaning member 43, then passes once the space S2 of the cleaning member 43, is blocked by the inner wall 22*e* of the toner cartridge 22*a*, and is then blocked again at the space S1 between transparent plates 44 and 45. In accordance with this, the light-receiving output of the phototransistor of the remaining toner sensor 53 changes from high level, to low level, to high level, and to low level as shown in FIG. 18(*b*). Then, after the toner cartridge 22*a* is removed, when the control portion 61 detects the time t1 of the first low level shown in FIG. 18(*b*), it is presumed that the mounting of the new toner cartridge 22*a* has been started, and correction of the remaining toner sensor 53 being monitored is carried out at the time t2 of the next high level. This correction involves varying the duty ratio of the rectangular wave output corresponding to the drive current of the light-emitting diode of the remaining toner sensor 53, varying the resistance load of the phototransistor of the remaining toner sensor 53 with the ON and OFF of the transistors 72*a* to 72*d* so that the light-receiving output level of the phototransistor can be adjusted to a rated value, then obtaining the duty ratio of the rectangular wave output and the ON/OFF state of the transistors 72*a* to 72*d* when the light-receiving output level becomes the rated value, and these duty ratios of the rectangular wave output and ON/OFF states of the transistors 72*a* to 72*d* are recorded in the correction data table D.

It should be noted that, not only for the toner cartridge 22*a* but also for the other toner cartridges 22*b* to 22*d*, once it is determined that there is no remaining toner in the toner cartridge, correction of the remaining toner sensor is carried out during the attachment/removal of the toner cartridge when the front door of the image forming apparatus is opened.

Furthermore, the removal of the toner cartridge is detected based on the variation pattern of the light-receiving output of the remaining toner sensor 53 shown in FIG. 18(*a*), but it is also possible to arrange individual sensors and limit switches and the like for detecting toner cartridge removal for each toner cartridge. In this case, it is also possible that, regardless of whether or not it is determined that there is no remaining toner, the light-emitting diode of the remaining toner sensor 53 of the developing device that is attached to the toner cartridge is caused to continuously emit light from the time the removal of the toner cartridge is detected, and monitoring the light-receiving output of the phototransistor of the remaining toner sensor 53 is continued, with correction of the remaining toner sensor carried out during the time t2 when the toner cartridge is attached.

In this way, with the present example, the light-emitting portion 55 and the light-receiving portion 56 of the remaining toner sensor 53 are coupled to the upper indentation 22*i* and the lower indentation 22*j* of the toner cartridge 22 such that the light-emitting diode 57 and the phototransistor 58 face each other through the transparent plates 44 and 45. This forms a light path in which light from the light-emitting diode 57 is incident on the phototransistor 58 via the transparent plates 44 and 45. Then, when the level of toner in the toner cartridge 22 exceeds the lower side transparent plate 45, light is not received by the phototransistor 58, and when the level of toner is between the transparent plates 44 and 45, a weak light is received by the phototransistor 58, and when the level of toner is at or below the lower side transparent plate 45, almost all of the light from the light-emitting diode 57 is received by the phototransistor 58 without being weakened. For this reason, the level of remaining toner in the toner cartridge 22 can be determined based on the output level of light received at the phototransistor 58.

Furthermore, since the upper indentation 22*i* and the lower indentation 22*j* are provided, even when toner drops from above, the upper indentation 22*i* acts as a roof so that the toner is prevented from directly dropping on the transparent plates 44 and 45, and it is difficult for the transparent plates 44 and 45 to become smeared. In this way, it is possible to always accurately determine the level of remaining toner. Furthermore, since toner does not drop directly on the space S1 between the transparent plates 44 and 45, the toner level in the space S1 is kept stable such that very accurate determinations can be made of the level of toner remaining.

Furthermore, with color image forming apparatuses, toner cartridges 22*a* to 22*d*, which contain toners of different colors, and developing devices 21*a* to 21*d*, which form toner images of the different colors, are arranged in tandem, thus making it difficult to miniaturize such image forming apparatuses. However, by arranging the toner cartridges in the vicinity of the front door, it is possible keep each toner cartridge close to the front door, thus it becomes possible to achieve miniaturization of an image forming apparatus. In particular, if a height h of the toner cartridge is set longer than a depth t of the toner cartridge and thus making the width of the toner cartridge even narrower, the toner cartridge can be miniaturized such that the image forming apparatus can also be further miniaturized. Furthermore, it also makes it easier to attach and remove the toner cartridges with respect to the image forming apparatus.

It should be noted that the present invention is not limited to the above-described examples, but includes other various variations. For example, it is also possible to form the flexible film piece 49 with a transparent material and for the width of one end of the rods 48*a* that support the flexible film piece 49 to be narrower than the width of the light path between the light-emitting diode and the phototransistor of the remaining toner sensor 55. In this case, when the flexible film piece 49 and the one end of the rods 48*a* pass through the space S1 between the transparent plates 44 and 45, the light path is not completely blocked by the flexible film piece 49 and the one end of the rods 48*a*, thus making it possible to determine the remaining toner. Accordingly, as described above, by slightly displacing the rotation cycle T of the flexible film 49 and the detection cycle Ts of the remaining toner sensor 55, it is not necessary to extract the plurality of same detection results.

Furthermore, instead of recording the duty ratio of the rectangular wave output and the ON/OFF state of the transistors 72*a* to 72*d* when the light-receiving output level of the phototransistor becomes the rated value in the correction data table D for each remaining toner sensor 53 individually, it is possible to record in the correction data table D the light-receiving output of the phototransistor when the duty ratio of the rectangular wave output is held constant and the load on the phototransistor is held constant. In this case, the duty ratio of the rectangular wave output and the load of the phototransistors are obtained and set so that the light-receiving output of the phototransistors becomes a rated value based on the light-receiving output levels of the phototransistors in the correction data table D.

Furthermore, instead of correcting the toner detection sensitivity of the remaining toner sensor 53 by varying the drive current of the light-emitting diode of the remaining toner sensor 53 and varying the load resistance of the phototransistor of the remaining toner sensor 53, it is possible to correct the toner detection sensitivity of the remaining toner sensor 53 for each toner level detection by changing the reference values that are compared with the light-receiving output of the phototransistors for determining the remaining toner.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A remaining toner detection apparatus wherein a light-emitting element and a light-receiving element of a remaining toner sensor are detachably fitted to a toner cartridge, and that detects an amount of toner remaining in the toner cartridge based on a light-receiving output of the light-receiving element when the light-emitting element emits light;

wherein, a pair of indentations is formed with a vertical spacing on a side wall of the toner cartridge and project inwardly of the toner cartridge, said indentations having upper and lower surfaces with the upper surface of one of the indentations and the lower surface of the other indentation being vertically opposed, respective translucent windows are arranged on opposing upper and lower surfaces of the indentations protruding into the toner cartridge, defining a horizontally disposed gap between said surfaces, and the light-emitting element and the light-receiving element of the remaining toner sensor are inserted into the indentations such that the light-emitting element and the light-receiving element of the remaining toner sensor face each other across said gap via the translucent windows of the indentations.

2. The remaining toner detection apparatus according to claim 1, comprising a sweeping member that sweeps the translucent windows by intermittently passing through said gap between surfaces of the translucent windows.

3. The remaining toner detection apparatus according to claim 2, which further includes an agitator member, and wherein the sweeping member operates together with an agitation movement of said agitator member that agitates toner in the toner cartridge and intermittently passes said sweeping member between the surfaces of the translucent windows.

4. The remaining toner detection apparatus according to claim 2, wherein the sweeping member sweeps the surfaces of the translucent windows by passing through said gap in a substantially horizontal direction between the surfaces of the translucent windows.

5. The remaining toner detection apparatus according to claim 2, which further comprises a support structure for supporting the sweeping member;

the sweeping member comprises a transparent material and is supported by one end of the support structures;

a light emitted from the light emitting element to the light receiving element forms a light path having a width; and said one end of said support structure extends in the same direction as the width of said light path and has a width than the width of said light path.

6. The remaining toner detection apparatus according to claim 2, wherein the sweeping member comprises a flexible film.

7. The remaining toner detection apparatus according to claim 1, said apparatus being associates with a developing device in an image forming apparatus, said developing device having a depth dimension and said toner cartridge having depth and height dimensions, wherein a depth of the toner cartridge is set shorter than a depth of the developing device in the image forming apparatus, and a height of the toner cartridge is set longer than the depth of the toner cartridge.

8. The remaining toner detection apparatus according to claim 7, wherein said image forming apparatus has an openable-closable front door therein, and wherein the toner cartridge is arranged in a vicinity of said openable-closeable front door in said image forming apparatus.

9. The remaining toner detection apparatus according to claim 1, which further includes an agitator member that agitates toner in the toner cartridge about a center of agitation, said agitation member is rotatably supported at said center of agitation to provide an agitation movement upon rotation, and wherein the remaining toner sensor is under the center of agitation.

10. The remaining toner detection apparatus according to claim 1, which further includes an agitator member that agitates toner in the toner cartridge about a center of agitation, said agitation member is rotatably supported at said center of agitation to provide an agitation movement upon rotation, and wherein the remaining toner sensor is arranged directly under that center of agitation.

11. An image apparatus comprising a remaining toner detection apparatus according to any of the claims 1-6, 9, and 10;

said apparatus including a toner cartridge removably associated with a developing device in an image forming apparatus, said image apparatus having an openable-closable front door therein; and wherein said apparatus further comprises a plurality of toner cartridges and a plurality of developing devices into which the plurality of toner cartridges are detachably fitted, all arranged in tandem, and the plurality of toner cartridges are arranged in the vicinity of the openable-closeable front door.

12. The image forming apparatus comprising a toner detection apparatus according to claim 8, wherein said toner cartridge is removably associated with said developing device; and wherein said apparatus further comprises a plurality of toner cartridges and a plurality of developing devices into which the toner cartridges are detachably fitted, all arranged in tandem, and the plurality of toner cartridges are in the vicinity of the openable-closable front door.

13. A remaining toner detection apparatus including a toner cartridge, a light-emitting element and a light-receiving element fitted to the toner cartridge in a vertically stacked configuration defining a horizontal gap there between, wherein the remaining toner in the toner cartridge is detected based on a light-receiving output of the light-receiving element when the light-emitting element emits light, said elements communicating through respective light emitting and light receiving faces, and sweeping comprising a flexible film for passing said film through said horizontal gap, such that the light-emitting face and the light-receiving face are swept by the flexible film.

* * * * *